US011786833B2

(12) United States Patent
Del Giudice et al.

(10) Patent No.: US 11,786,833 B2
(45) **Date of Patent: *Oct. 17, 2023**

(54) TOY SYSTEM

(71) Applicant: MOOSE CREATIVE MANAGEMENT PTY LIMITED, Cheltenham (AU)

(72) Inventors: Dean Del Giudice, Melbourne (AU); Carl Budd, Victoria (AU); Tori Salvaggio, Victoria (AU); James Austin-Smith, Cornwall (GB); Ross Monks, Cornwall (GB); David Emblin, Cornwall (GB)

(73) Assignee: MOOSE CREATIVE MANAGEMENT PTY LIMITED, Cheltenham (AU)

( * ) Notice: Subject to any disclaimer, the term of this patent is extended or adjusted under 35 U.S.C. 154(b) by 28 days.

This patent is subject to a terminal disclaimer.

(21) Appl. No.: 17/451,121

(22) Filed: Oct. 15, 2021

(65) Prior Publication Data

US 2022/0118373 A1 Apr. 21, 2022

Related U.S. Application Data

(60) Provisional application No. 63/094,190, filed on Oct. 20, 2020.

(51) Int. Cl.
*A63H 3/52* (2022.01)
*A63H 3/00* (2006.01)
(Continued)

(52) U.S. Cl.
CPC ..... *A63H 3/52* (2013.01); *A63H 3/006* (2013.01); *A63H 3/28* (2013.01); *B05B 7/1686* (2013.01); *B05B 7/22* (2013.01)

(58) Field of Classification Search
CPC ..... A63H 3/005; A63H 3/006; A63H 3/28; A63H 3/52; A63H 13/16; A63J 21/00
(Continued)

(56) References Cited

U.S. PATENT DOCUMENTS 2,460,328 A * 2/1949 Young ..... G09F 27/00 40/506
2,628,449 A * 2/1953 Raizen ..... A63H 33/28 446/17

(Continued)

FOREIGN PATENT DOCUMENTS

| | | |
|---|---|---|
| DE | 1022508 B | 1/1958 |
| ES | 1018850 U | 2/1992 |
| JP | 4429024 B2 | 3/2010 |

OTHER PUBLICATIONS

Search Report and Written Opinion issued in corresponding International application No. PCT/US2021/055251, dated Mar. 28, 2022.

*Primary Examiner* — Joseph B Baldori
(74) *Attorney, Agent, or Firm* — Knobbe Martens Olson & Bear, LLP

(57) ABSTRACT

An interactive toy system is shown and described. The toy system can include a container forming a receptacle and having a top opening and a carriage. The carriage is disposed in the receptacle and rotatable about an axis between a first position and a second position. The carriage has a first receiving space and a second receiving space. The first receiving space is accessible through the top opening when the carriage is in the first position and inaccessible when the carriage is in the second position. The second receiving space is accessible through the top opening when the carriage is in the second position and inaccessible when the carriage is in the first position. The toy system can include
(Continued)

a fog system configured to generate fog within the container. The fog obfuscating the first receiving space.

22 Claims, 23 Drawing Sheets

(51) Int. Cl.
*A63H 3/28* (2006.01)
*B05B 7/16* (2006.01)
*B05B 7/22* (2006.01)

(58) Field of Classification Search
USPC ..... 446/24, 71, 72, 73, 74, 75, 76, 268, 310
See application file for complete search history.

(56) References Cited

U.S. PATENT DOCUMENTS 2,732,207 A 1/1956 Greer
3,160,980 A * 12/1964 Seuthe ..... A63H 33/28 446/25
3,880,484 A * 4/1975 Sicina ..... A47B 49/004 312/197
4,023,794 A * 5/1977 Adams ..... A63J 21/00 472/63
4,026,066 A * 5/1977 Reiner ..... A63H 33/22 446/236
5,041,044 A * 8/1991 Weinreich ..... A63H 33/22 40/442
5,346,433 A * 9/1994 Weinreich ..... A63J 21/00 472/63
5,458,525 A 10/1995 How
5,522,758 A 6/1996 Liu et al.
5,779,552 A * 7/1998 Gelfond ..... A63J 21/00 472/67
5,989,092 A 11/1999 McGowan et al.
6,168,531 B1 * 1/2001 Adamson ..... A63H 33/3055 472/65
6,231,346 B1 * 5/2001 Sagi-Dolev ..... G09B 23/00 446/73
7,361,073 B2 * 4/2008 Martin ..... A63H 30/00 446/175
8,133,090 B2 3/2012 Hardin
8,737,826 B2 * 5/2014 Stauffer ..... A63J 5/025 392/401
2003/0202785 A1 * 10/2003 Monitto ..... A63J 5/025 392/405
2006/0009117 A1 * 1/2006 Severson ..... A63H 19/14 446/410
2007/0149091 A1 * 6/2007 Viohl ..... A63H 3/28 446/484
2008/0016885 A1 * 1/2008 Hoover ..... A63J 5/025 62/50.2
2008/0166945 A1 * 7/2008 Cheng ..... A63H 11/20 446/268
2014/0094082 A1 4/2014 Swartz et al.
2017/0128825 A1 * 5/2017 Wu ..... A63H 30/04
2019/0160385 A1 5/2019 McDonald et al.
2019/0224444 A1 7/2019 Kalensky
2019/0328165 A1 10/2019 Cirri et al.
2020/0108326 A1 * 4/2020 Pyo ..... A63H 33/003
2020/0251016 A1 * 8/2020 Vuong ..... A63H 33/28
2022/0118373 A1 * 4/2022 Del Giudice ..... A63H 3/006
2022/0193572 A1 * 6/2022 Lyons ..... A63J 21/00
2023/0008010 A1 * 1/2023 Del Giudice ..... A63J 21/00

* cited by examiner

TOY SYSTEM

CROSS-REFERENCE TO RELATED APPLICATION

This application claims benefit under 35 U.S.C. 119(e) to U.S. Provisional Patent App. No. 63/094,190, filed Oct. 20, 2020, the entire disclosure of which is hereby incorporated by reference herein in its entirety. Any and all priority claims identified in the Application Data Sheet, or any corrections thereto, are hereby incorporated by reference under 37 CFR 1.57.

BACKGROUND

Field

A toy system is described. More specifically, embodiments of the toy system provide an interactive experience for a user along with an unboxing or reveal experience. The unboxing or reveal experience can include the generation and use of fog to enhance the experience. In certain embodiments, the toy system can be reused not only with the toy of the toy system but also with other toys.

SUMMARY

An aspect of the invention is directed to a toy system. The toy system comprises comprising a container that forms a receptacle and has a top opening. The toy system further includes a carriage disposed in the receptacle and rotatable about an axis between a first position and a second position. The carriage has a first receiving space and a second receiving space. The first receiving space is accessible through the top opening when the carriage is in the first position and inaccessible when the carriage is in the second position. The second receiving space is accessible through the top opening when the carriage is in the second position and inaccessible when the carriage is in the first position.

Additional aspects further comprise a toy or doll disposed in the second receiving space, the toy being accessible through the top opening when the carriage is in the second position.

Additional aspects further comprise wherein the container is sized and shaped as a cauldron, and wherein the cauldron comprises an upper portion and a lower portion, the lower portion being removable from the upper portion.

Additional aspects further comprise wherein the first receiving space is configured to hold a liquid when the carriage is in the first position.

Additional aspects further comprise wherein a portion of the receptacle below the carriage comprises a reservoir, the reservoir being configured to hold the liquid when the carriage is moved to the second position.

Additional aspects further comprise wherein rotation of the carriage about the axis transfers the liquid from the first receiving space to the receptacle.

Additional aspects further comprise wherein transfer of the liquid from the first receiving space to the receptacle is due to gravity.

Additional aspects further comprise one or more springs and a lock, the one or more springs being configured to bias rotation of the carriage to the second position, the lock having a lock position and an unlock position, the lock preventing the one or more springs from rotating the carriage to the second position when the lock is in the lock position.

Additional aspects further comprise a motor and gearbox configured to move the lock to the unlock position allowing the one or more springs to rotate the carriage to the second position.

Additional aspects further comprise a fog system configured to generate fog within the container, the fog obfuscating the first receiving space.

Additional aspects further comprise wherein the fog generated by the fog system fills the first receiving space.

Additional aspects further comprise wherein the fog generated by the fog system covers the view of the first receiving space.

Additional aspects further comprise wherein the fog system comprises a heater coil and a fan, the heater coil being configured to cause a phase change of a liquid into the fog, the fan being configured to blow the fog into at least the first receiving space.

Additional aspects further comprise wherein the fog system comprises a heater coil and a fan, the heater coil being configured to cause a phase change of a liquid into the fog, the fan being configured to blow the fog into the second receiving space first, then rising into the first receiving space.

Additional aspects further comprise wherein the first receiving space has a cylindrical shape.

Additional aspects further comprise wherein the container further comprises a knock sensor configured to detect a vibration or a knock against the container.

Additional aspects further comprise wherein the second position is 180 degrees about the axis from the first position.

Additional aspects further comprise wherein the carriage is rotatable about the axis when a user moves the carriage from the second position to the first position.

Additional aspects further comprise wherein the top opening is in register with the first receiving space when the carriage is in the first position and in register with the second receiving space when in the second position.

Additional aspects further comprise a wand having a magnet, and wherein the toy further comprises a hall sensor, the hall sensor being triggered when in the presence of the magnet to cause the toy to broadcast sound and emit light.

Additional aspects further comprise the toy comprises a cap sensor, the cap sensor being configured to cause the toy to broadcast sound and emit light when activated.

Additional aspects further comprise wherein the liquid can be refilled by a pipette and/or bottle passing through a passage in the carriage.

Additional aspects further comprise wherein an entrance to the passage has a non-circular shape that matches a shape of the pipette and/or bottle.

Additional aspects further comprise wherein the liquid is vegetable glycerin, propylene glycol, and water or mix thereof.

Additional aspects further comprise an enclosure, the enclosure being configured to releasable secure to the second receiving space, the enclosure being sized and shaped to receive another toy.

Additional aspects further comprise one or more lights, the one or more lights being disposed in the receptacle and configured to illuminate the fog and other liquid in the first receiving space.

Another aspect of the invention is directed to a method of unboxing a toy from a container that has a receptacle and a top opening. The receptacle has a carriage disposed therein and rotatable about an axis between a first position and a second position. The carriage has a first receiving space and a second receiving space. The toy is disposed in the second receiving space. The method includes pouring a first liquid through the top opening and into the first receiving space when the carriage is in the first position, generating fog within the container from a second liquid, the fog obfuscating the first receiving space, and rotating the carriage from the first position to the second position revealing the toy in the container.

Additional aspects further comprise removing the toy from the second receiving space, placing a second toy in the second receiving space, rotating the carriage from the second position to the first position, adding the second liquid to the carriage, pouring the first liquid through the top opening and into the first receiving space when the carriage is in the first position, generating fog within the container from the added second liquid, the fog obfuscating the first receiving space, and rotating the carriage from the first position to the second position revealing the second toy in the container.

Additional aspects further comprise wherein the second toy is the toy.

Additional aspects further comprise wherein the second toy is a different toy than the toy.

Additional aspects further comprise securing an enclosure in the second receiving space, the enclosure being sized and shaped to receive the second toy, wherein placing the second toy in the second receiving space comprises placing the second toy in the enclosure.

Another aspect of the invention is directed to a fog system for use with a container. The container has a receiving space. The fog system comprises a heater coil configured to cause a phase change of a liquid into a fog, the fog having a first temperature, a cooling duct configured to receive and distribute the fog into the receiving space, the cooling duct being sized so as to absorb sufficient thermal energy from the fog when the fog passes through the cooling duct to lower the first temperature to a second temperature, and a fan configured to blow the fog through the cooling duct.

Additional aspects further comprise wherein the fog generated by the fog system fills and obfuscates the receiving space.

BRIEF DESCRIPTION OF THE DRAWINGS

Various embodiments are depicted in the accompanying drawings for illustrative purposes and should in no way be interpreted as limiting the scope of the embodiments. In addition, various features of different disclosed embodiments can be combined to form additional embodiments, which are part of this disclosure.

DETAILED DESCRIPTION

The toy system 30 disclosed herein includes one or more features such as casting spells in a cauldron, using an interactive wand, causing a toy to come to life when removed from the cauldron, generating fog, providing an interactive electronic toy/doll, and allowing repeat play of the above as well as repeat play with other toys.

Figure 1:
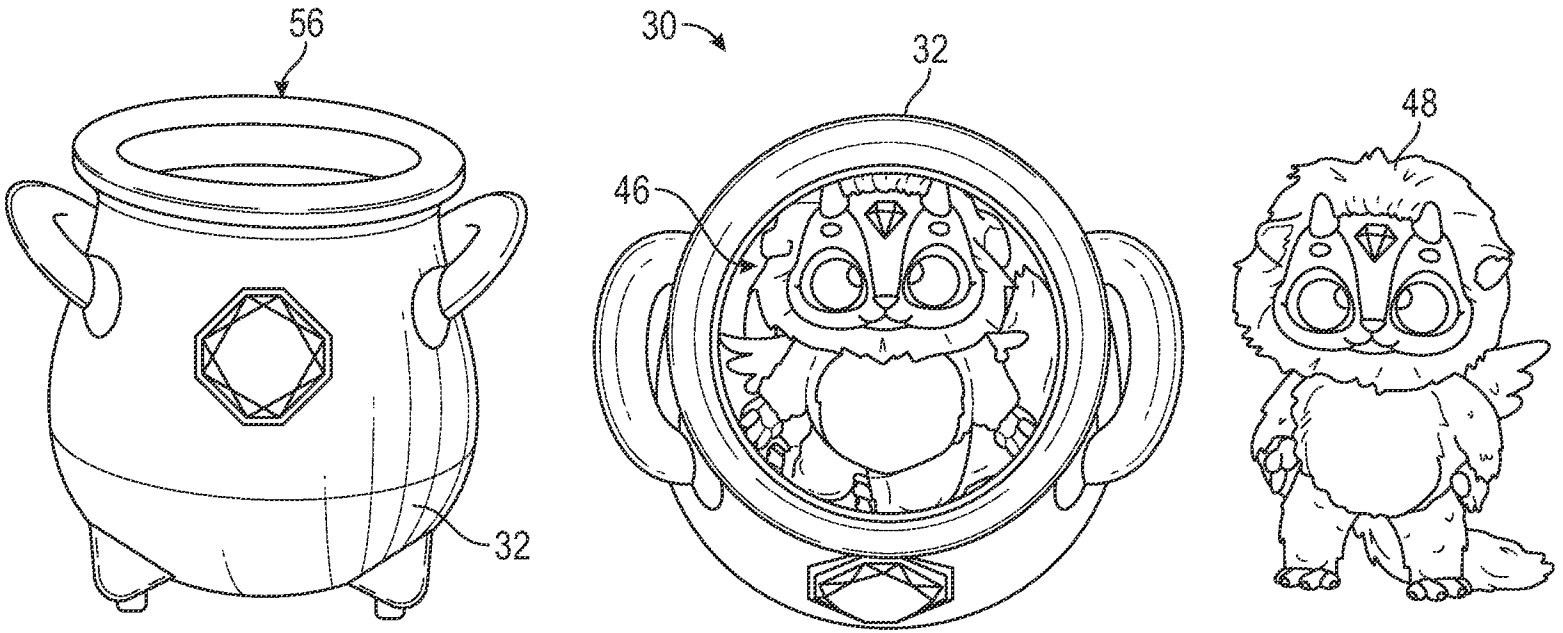
FIG. 1 includes front and top perspective views of a toy system that includes a container or cauldron forming a receptacle sized and shaped to receive a toy or doll therein according to a preferred embodiment of the present invention. The toy or doll is shown inside the cauldron as well as after removal from the cauldron.

FIG. 1 includes front and top perspective views of a toy system 30. In certain embodiments, the toy system 30 includes a container 32 forming a receptacle 56 sized and shaped to receive a toy or doll 48 therein according to a preferred embodiment of the present invention. In certain embodiments, the container 32 has a top opening 46. The doll 48 is shown inside the container 32 and after removal from the container 32. In certain embodiments, the container 32 is shaped like a cauldron. Of course, the shape of the container 32 is not limited to being round and can have any other shape (e.g., square, oblong, egg-shaped, cylindrical, etc.). In other embodiments, the container 32 includes a removable cover or top structure.

Figure 2:
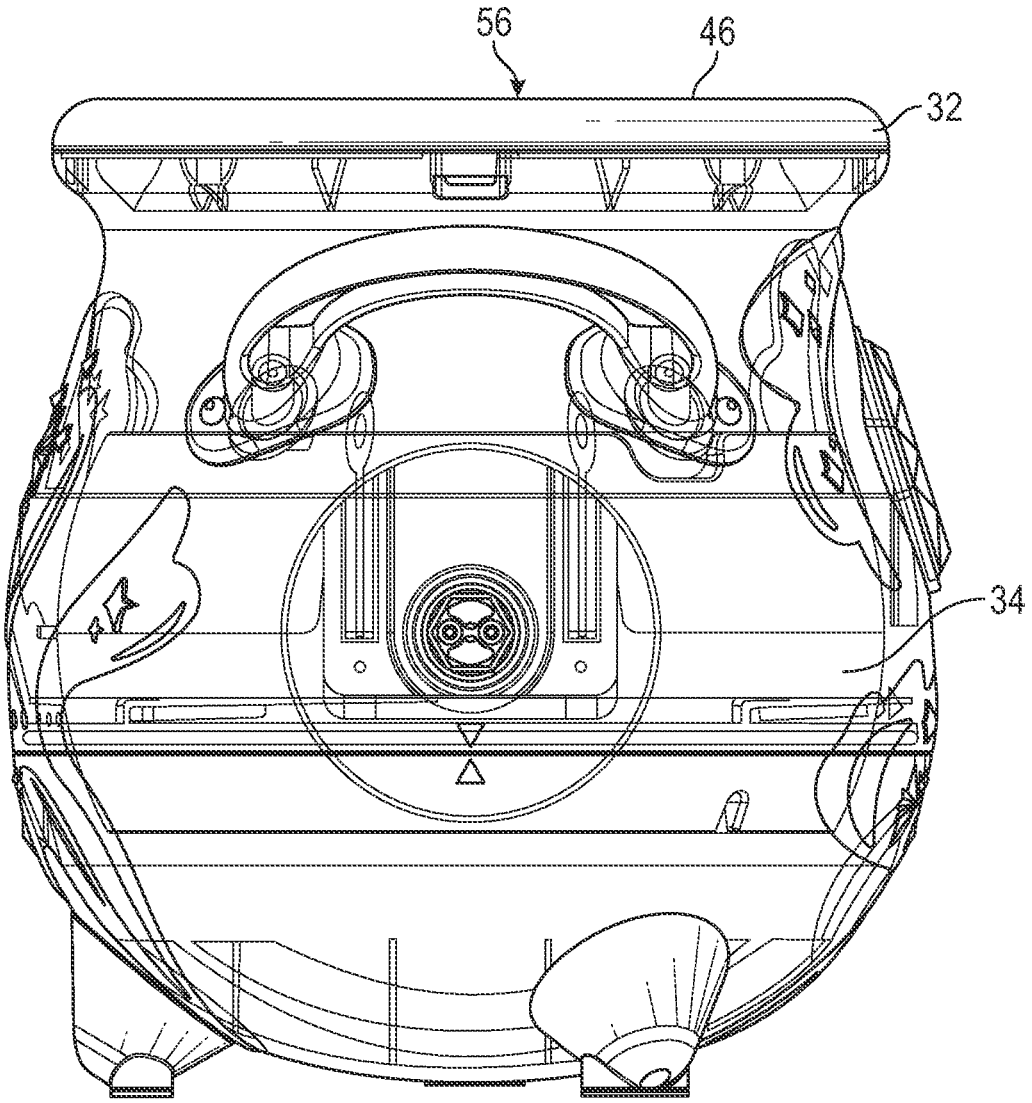
FIG. 2 is a partially transparent front view of the cauldron showing a movable carriage disposed within the cauldron.

FIG. 2 is a partially transparent front view of the container 32 from FIG. 1 showing a carriage 34. In certain embodiments, the carriage 34 is disposed within the container 32. In certain embodiments, at least a portion of the electronics for the toy system 30 are located in the carriage 34. In the illustrated embodiments, at least some of the electronics are located in the center of the container 32. In certain embodiments, at least some of the electronics are located between the walls of the container 32.

Figure 12:
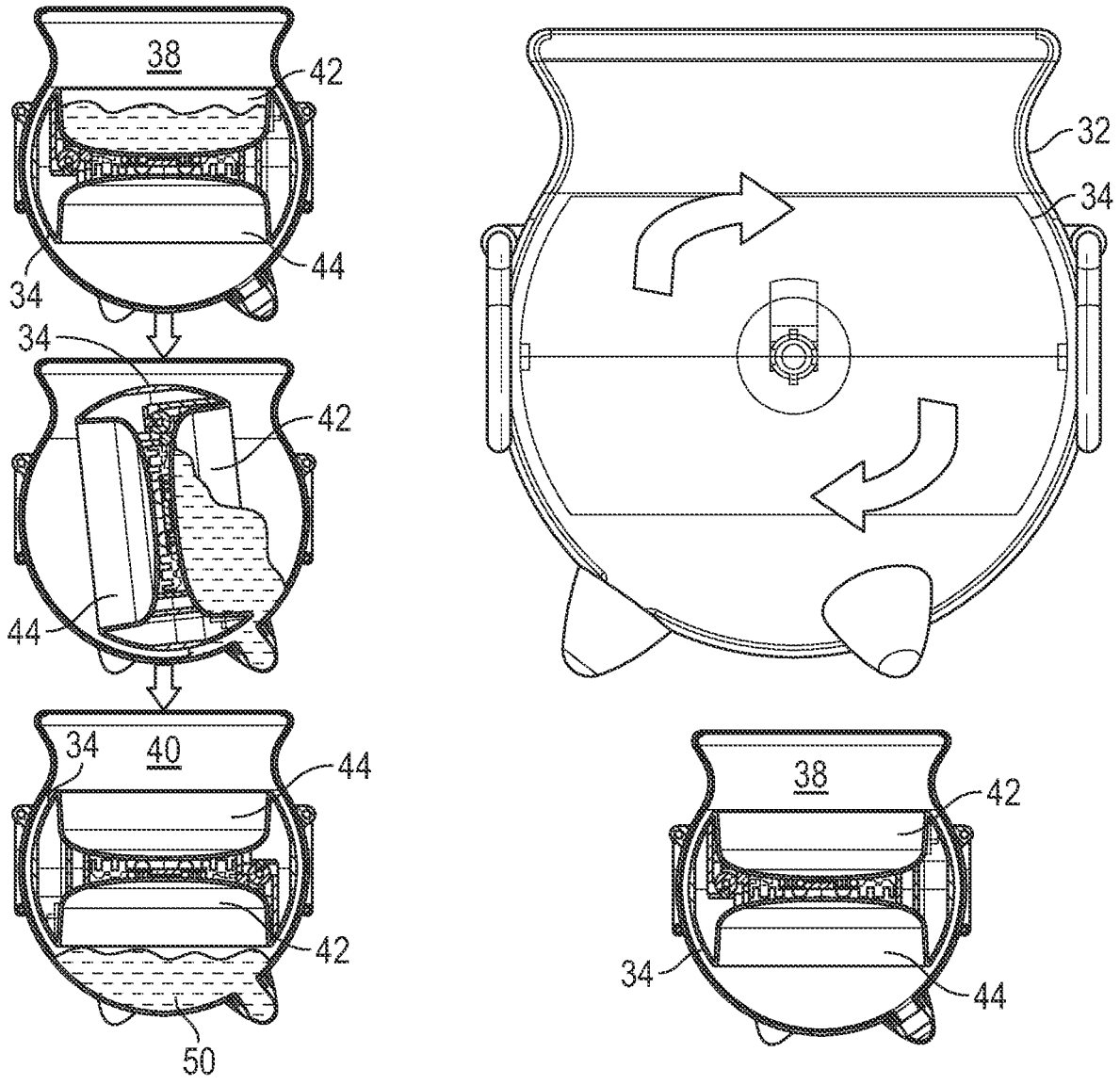
FIG. 12 includes a series of views of the carriage as the carriage is rotated within the cauldron from a first position to a second position.

In certain embodiments, the carriage 34 is disposed in the receptacle 56 and rotatable about an axis 36 between a first position 38 and a second position 40 (see FIG. 12). In certain embodiments, the carriage 34 has a first receiving space 42 and a second receiving space 44 (see FIG. 12). In certain embodiments, the first receiving space 42 is accessible through the top opening 46 when the carriage 34 is in the first position 38 and inaccessible through the top opening 46 when the carriage 34 is in the second position 40. In certain embodiments, the second receiving space 44 is accessible through the top opening 46 when the carriage 34 is in the second position 40 and inaccessible through the top opening 46 when the carriage 34 is in the first position 38. In certain embodiments, the toy or doll 48 is disposed in the second receiving space 44.

In certain embodiments, the container 32 is filled with a liquid. For example, in certain embodiments, the container 32 is turned on and filled with water using a measuring jug. In certain embodiments, the container 32 turns on in response to the water activating one or more water sensors 108 in the first receiving space 42 (see FIG. 13). In certain embodiments, one or more fizzes or water soluble items are added to the water. In certain embodiments, the container 32 is tapped by a wand 100 on a side of the container 32 (see FIG. 17). The water can be stirred. In certain embodiments, the tapping causes the container 32 to emit lights and/or sound. In certain embodiments, the wand 100 lights up when the wand 100 is placed inside the container 32. In certain embodiments, power is wirelessly transferred from the container 32 to the wand 100.

In certain embodiments, the toy system 30 can include a fog system 62 configured to generate fog within the container 32. In certain embodiments, the fog generated by the fog system 62 obfuscates the first receiving space 42.

Figure 3:
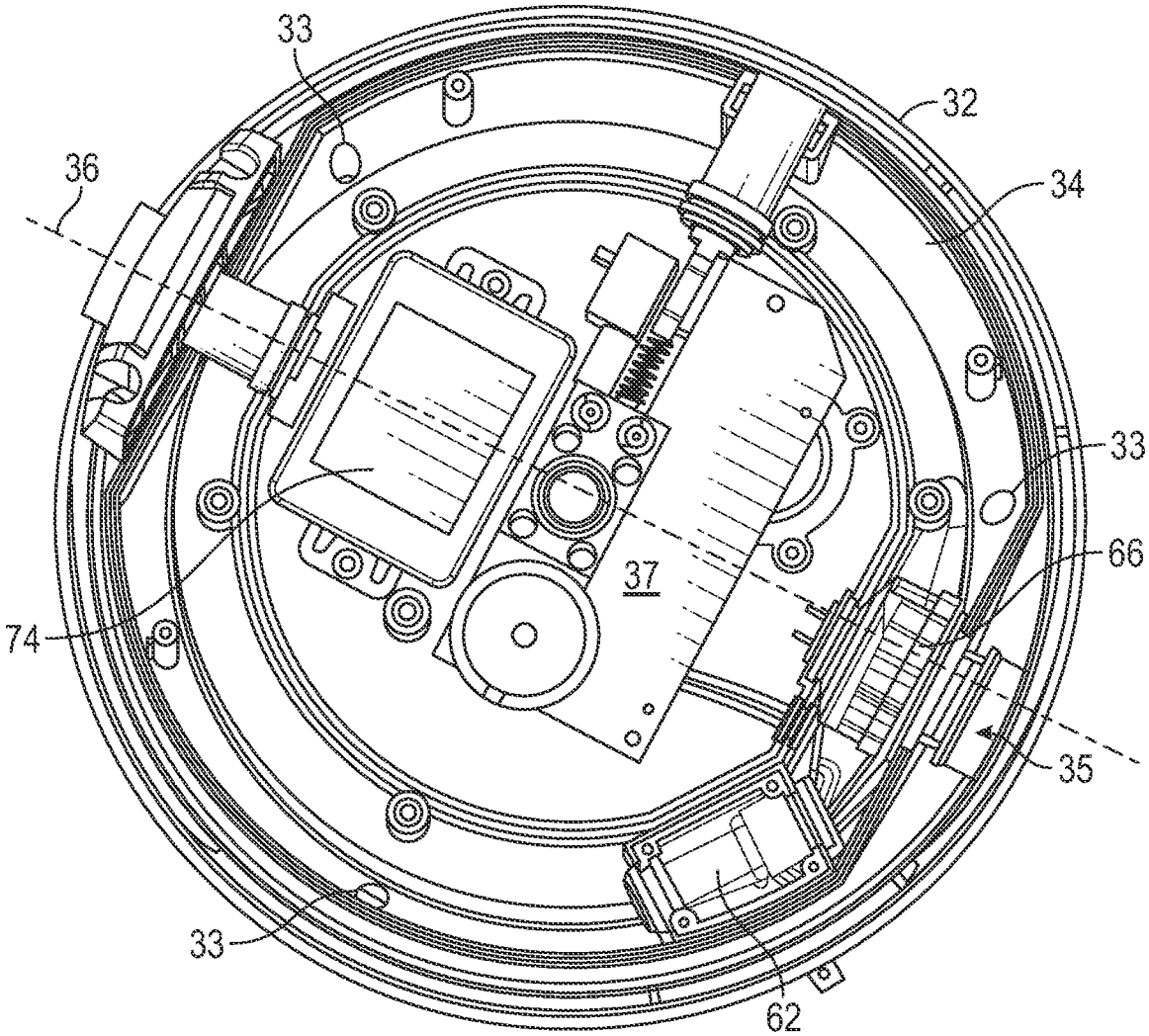
FIG. 3 is a cross-section view of the cauldron and carriage from FIG. 2 and shows a top side of a fog system.
Figure 4:
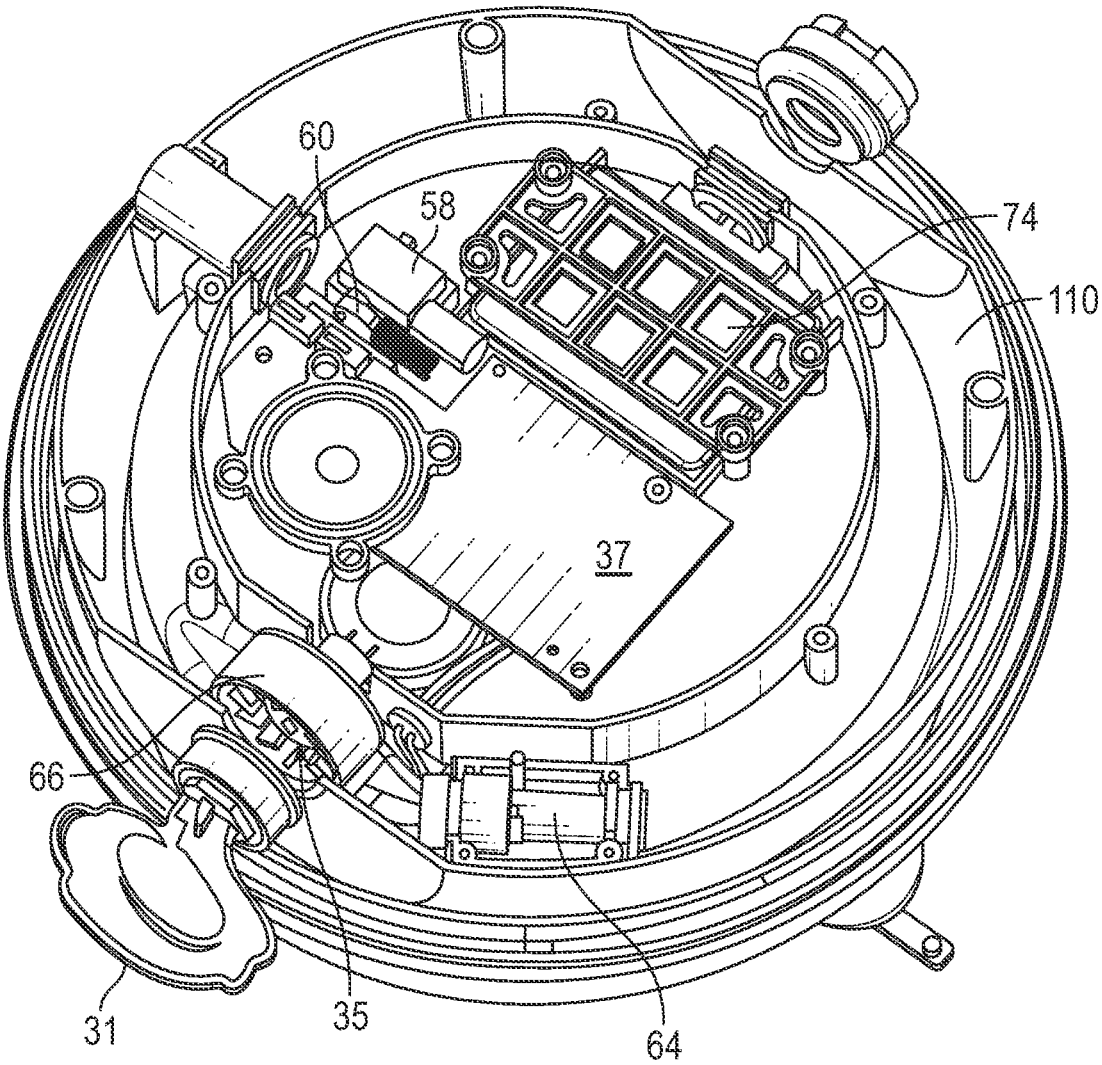
FIG. 4 is a cross-section view of the cauldron and carriage from FIG. 2 and shows a bottom side of the fog system.

FIG. 3 is a cross-section view of the cauldron 32 and carriage 34 from FIG. 2 and shows, for example, a top side of the fog system 62. In certain embodiments, the carriage 34 comprises one or more printed circuit boards (PCB) 37. FIG. 4 is a cross-section view of the container 32 and carriage 34 from FIG. 2 and shows a bottom side of the fog system 62.

In certain embodiments, the fog system 62 comprises a heater coil 64 and a fan 66. In certain embodiments, the fog system 62 further comprises a tube filled with fog fluid. In certain embodiments, the fog fluid is placed near the heater coil 64. In certain embodiments, the liquid is vegetable glycerin, propylene glycol, and water or mix thereof. In certain embodiments, when the toy system 30 is triggered to begin a fog play pattern, the heater coil 64 heats up and turns the liquid to fog.

In certain embodiments, rolled up material is soaked in a fog fluid and placed near the heater coil 64. For example, in certain embodiments a soaked, wick is placed inside the heater coil 64.

In certain embodiments, the fog system 62 comprises an ultrasonic atomizer. In certain embodiments, the ultrasonic atomizer is disposed in the first receiving space 42 below a liquid, for example, water. In certain embodiments, the ultrasonic atomizer employs piezoceramics to generate ultrasonic waves within the water. In certain embodiments, the waves propagate though the water and are focused on the surface of the water. At the surface of the water, the ultrasonic waves create an aerosol of fog from the water. In certain embodiments, the fog obfuscates the first receiving space 42. In certain embodiments, the fog covers a view of the first receiving space 42. In certain embodiments, the fog system 62 further comprises a high frequency AC supply. The high frequency AC supply can be configured to drive the ultrasonic atomizer.

In certain embodiments, the ultrasonic atomizer need not be disposed in the first receiving space 42. For example, in certain embodiments, the ultrasonic atomizer is disposed in the carriage 34. For example, in certain embodiments, the ultrasonic atomizer is disposed in the carriage 34 and fed from the liquid in the first receiving space 42. In certain other embodiments, the ultrasonic atomizer is fed from a reservoir of liquid separate from the liquid in the first receiving space 42. In certain embodiments, the reservoir used to feed the ultrasonic atomizer is refillable by the user. In certain embodiments, air is drawn into the fog system 62, mixes with the aerosol of fog, and flows out of the fog system 62 as the fog. In certain embodiments, a scent is added to the liquid which is used to create the aerosol of fog. The scent can provide a distinctive smell to the aerosol of fog.

In certain embodiments, the fan 66 draws air into the fog system 62 through one or more inlets 35. In certain embodiments, the drawn in air then flows through the heater coil 64, mixes with the gaseous fog, and flows out of the fog system 62 as the fog. In certain embodiments, the fog leaves the fog system 62 and then enters one or more ducts 110. In certain embodiments, the one or more ducts 110 are disposed in the carriage 34. In certain embodiments, the one or more ducts 110 are disposed in the carriage 34 and within the walls of the container 32. As will be explained with respect to FIG. 22 and certain embodiments, the volume of the one or more ducts 110 can be selected to cause the fog leaving the heater coil 64 to cool before eventually exiting the carriage 34.

In certain embodiments, at least a portion of the fog exits the carriage 34 via one or more exit holes 33 and flows into at least a portion of the container or cauldron 32. In certain embodiments, at least a portion of the fog eventually fills the cauldron 32 in a brief period of time. At least a portion of the fog will obfuscate the user from observing through the top opening 46 the rotation of the carriage 34 within the container 32. In certain embodiments, at least a portion of the fog generated by the fog system 62 covers a view of the first receiving space 42. For example, in certain embodiments, at least a portion of the fog will fill at least a sufficient volume between the liquid in the first receiving space 42 and the top opening 46 to obfuscate the user from observing through the top opening 46 the rotation of the carriage 34 within the container 32. In certain embodiments, at least a portion of the fog flows before, during, and/or after the carriage 34 rotates to the second position 40.

In certain embodiments, at least a portion of the fog exits the carriage 34 from the bottom and/or top of the carriage 34 when the carriage 34 is in the first position 38. In certain embodiments, at least a portion of the fog flows from the carriage 34 into the first receiving space 42 and/or the second receiving space 44.

In the embodiment illustrated in FIG. 3, at least a portion of the fog exits the carriage 34 into the second receiving space 44 when the carriage 34 is in the first position 38. In certain embodiments, at least a portion of the fog continues to flow and fills the second receiving space 44. In certain embodiments, at least a portion of the fog flowing into the second receiving space 44 rises and flows into the first receiving space 42. In certain embodiments, at least a portion of the fog overflows from the second receiving space 44 into the first receiving space 42. In certain embodiments, once the second receiving space 44 is filled with fog, at least a portion of the fog rises around an outer perimeter of the carriage 34 and enters the first receiving space 42. In certain embodiments, at least a portion of the fog rises around an outer perimeter of the carriage 34 and enters the first receiving space 42 when the second receiving space 44 is not filled with fog. In certain embodiments, at least a portion of the fog flows before, during, and/or after the carriage 34 rotates to the second position 40. In certain embodiments, the rotation of the carriage 34 scoops at least a portion of the fog from the second receiving space 44 and brings the scooped fog to the top of the cauldron 32.

In certain embodiments, at least a portion of the fog exits the carriage 34 into the first receiving space 42 when the carriage 34 is in the first position 38. In certain embodiments, at least a portion of the fog continues to flow and fills the first receiving space 42. In certain embodiments, at least a portion of the fog flowing into the first receiving space 42 flows down into the second receiving space 44. In certain embodiments, at least a portion of the fog overflows from the first receiving space 42 into the second receiving space 44. In certain embodiments, at least a portion of the fog flows before, during, and/or after the carriage 34 rotates to the second position 40.

In certain embodiments, at least a portion of the fog exits the carriage 34 into both the first receiving space 42 and the second receiving space 44 when the carriage 34 is in the first position 38. In certain embodiments, at least a portion of the fog continues to flow and fills both the first receiving space 42 and the second receiving space 44. In certain embodiments, at least a portion of the fog flows before, during, and/or after the carriage 34 rotates to the second position 40.

In certain embodiments, the toy system 30 comprises the one or more ducts 110. In certain embodiments, the geometry (e.g., size, volume, length, width, height, area, etc.) of the one or more ducts 110 can vary. For example, in certain embodiments, the geometry of the one or more ducts 110 can be selected to achieve a desirable decrease in the temperature of the fog. In certain embodiments, cooling the fog within the one or more ducts 110 can increase the density of the fog causing the fog to stay closer to the surface of the first receiving space 42 rather than immediately rise and exit the top opening 46.

In certain embodiments, at least a portion of the one or more ducts 100 is located adjacent to the first receiving space 42. In certain embodiments, at least a portion of the one or more ducts 100 is located adjacent to a surface or wall that forms the first receiving space 42. When the first receiving space 42 is filled with room temperature water, a temperature of the wall will be lower than the temperature of the fog when the fog leaves the heater coil 64. Flowing the warmed fog through the duct 110 as well as adjacent to the filled first receiving space 42 further lowers the temperature of the fog. In this way, the density of the fog, which may have been less than the density of the surrounding air when exiting the heater coil 64, is increased to a value that is greater that the density of the air in the first receiving space 42. In certain embodiments, the fog system 62 includes one or more exit holes 33. In certain embodiments, the fog system 62 includes one or more exit holes 33. In certain embodiments, the one or more exit holes 33 can be located at any location within the container 32. In certain embodiments, the one or more exit holes 33 are distributed around a periphery of the carriage 34.

In certain embodiments, the fan 66 is directly connected to the motor 58. In certain embodiments, the fan 66 forces air through a tube containing the heater coil 64 and the fog liquid. In certain embodiments, the fan 66 blows the fog from the heater coil 64, through the one or more ducts 110, and out of the one or more exit holes 33.

Figure 5:
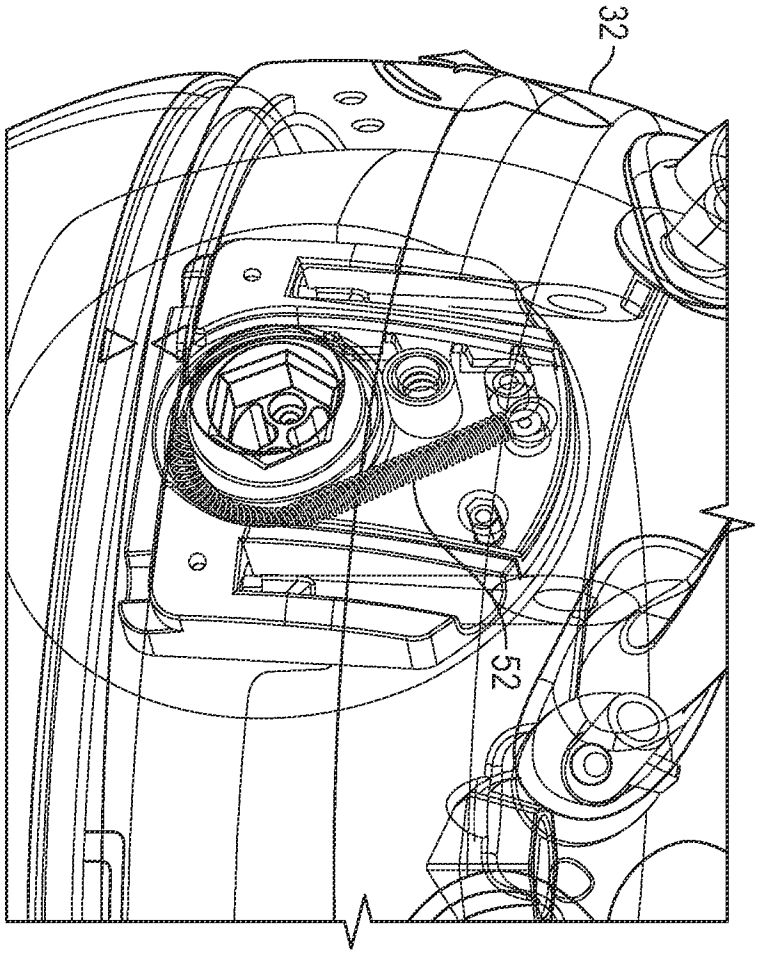
FIG. 5 is a front, right side view of the cauldron showing one or more tension and/or torsion springs configured to rotate the carriage within the cauldron.

FIG. 5 is a front, right side view of the cauldron or container 32 showing one or more tension and/or torsion springs 52 configured to rotate the carriage 34 within the cauldron or container 32. In certain embodiments, the one or more tension and/or torsion springs 52 can be disposed on one or both sides of the carriage 34. In certain embodiments, when the carriage 34 is unlocked, the one or more tension and/or torsion springs 52 is biased to rotate the carriage 34 to the second position 40.

Figure 6:
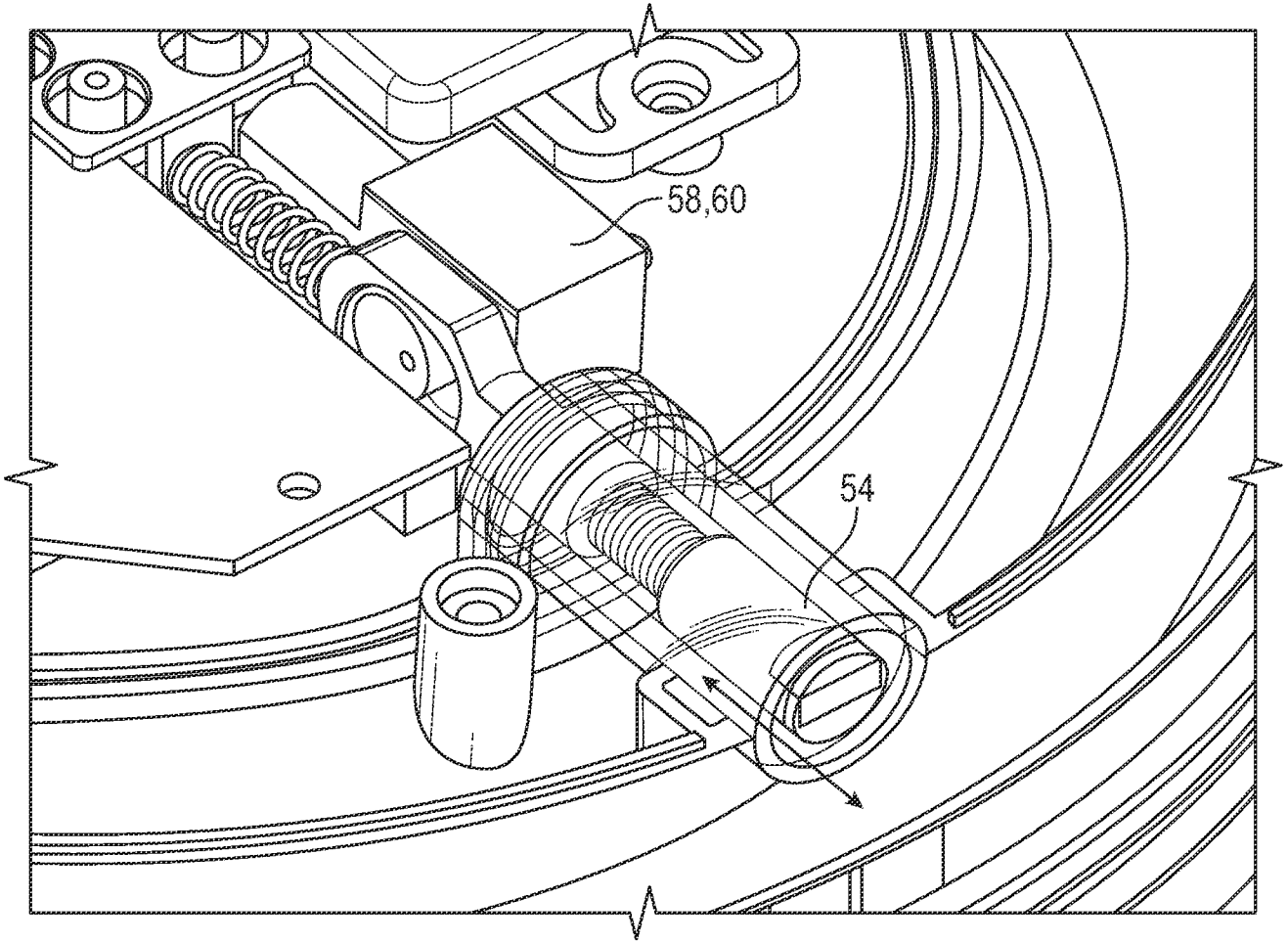
FIG. 6 is an enlarged view of a motor and gearbox from FIG. 3 configured to release the carriage to allow the carriage to rotate about an axis within the cauldron.

FIG. 6 is an enlarged view of a motor 58 and gearbox 60 from FIG. 3. In certain embodiments, the motor 58 and the gearbox 60 are configured to release the carriage 34 to allow the carriage 34 to rotate about an axis 36 within the container or cauldron 32. In certain embodiments, the motor 58 and the gearbox 60 are configured to release the carriage 34. For example, the motor 58 and gearbox 60 can turn a crank. In certain embodiments, the crank can be configured to retract a pin 54 supported by the carriage 34 from engagement with the container 32. In certain embodiments, when the pin 54 is retracted, the one or more tension and/or torsion springs 52 causes the carriage 34 to rotate relative to the container or cauldron 32.

In certain embodiments, the one or more tension and/or torsion springs 52 can be biased to rotate the carriage 34 to the second position 40. In certain embodiments, the user can rotate the carriage 34 by hand from the second position 40 back to the first position 38. In certain embodiments, the user can insert a reset key 31 into a keyhole 49 in the container 32 to rotate the carriage 34 back to the first position 38. In certain embodiments, once back in the first position 38, the crank will turn, pushing the pin 54 out to re-lock the carriage 34 in the first position 38 to the container 32.

Figure 7:
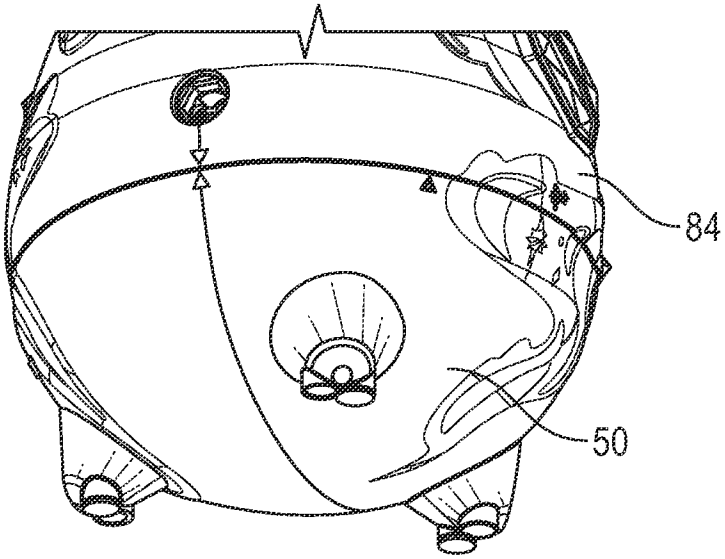
FIG. 7 are views of a removable lower portion of the cauldron from FIG. 2.
Figure 7:
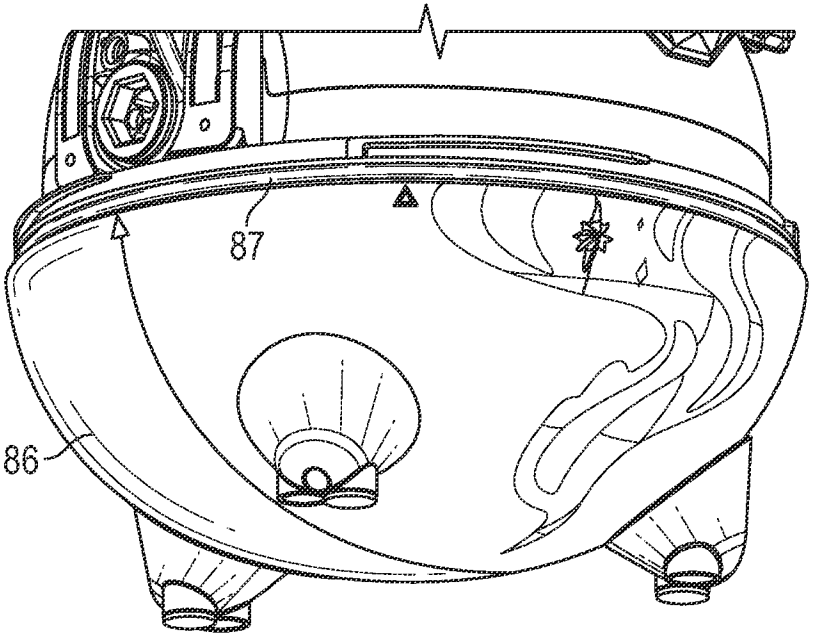

FIG. 7 are views of a removable lower portion 86 of the container or cauldron 32 from FIG. 2. In certain embodiments, the lower portion 86 can be unscrewed from the upper portion 84 if needed to remove the toy 48, clear blockage, and/or clean the reservoir 50. In certain embodiments, a seal 87, such as an O-ring, is disposed in the joint between the lower portion 86 and the upper portion 84. In certain embodiments, the seal 87 prevents liquid from leaking from the container or cauldron 32 when the lower portion 86 is secured to the upper portion 84. In certain embodiments, a screw secures the lower portion 86 to the upper portion 84.

Figure 8:
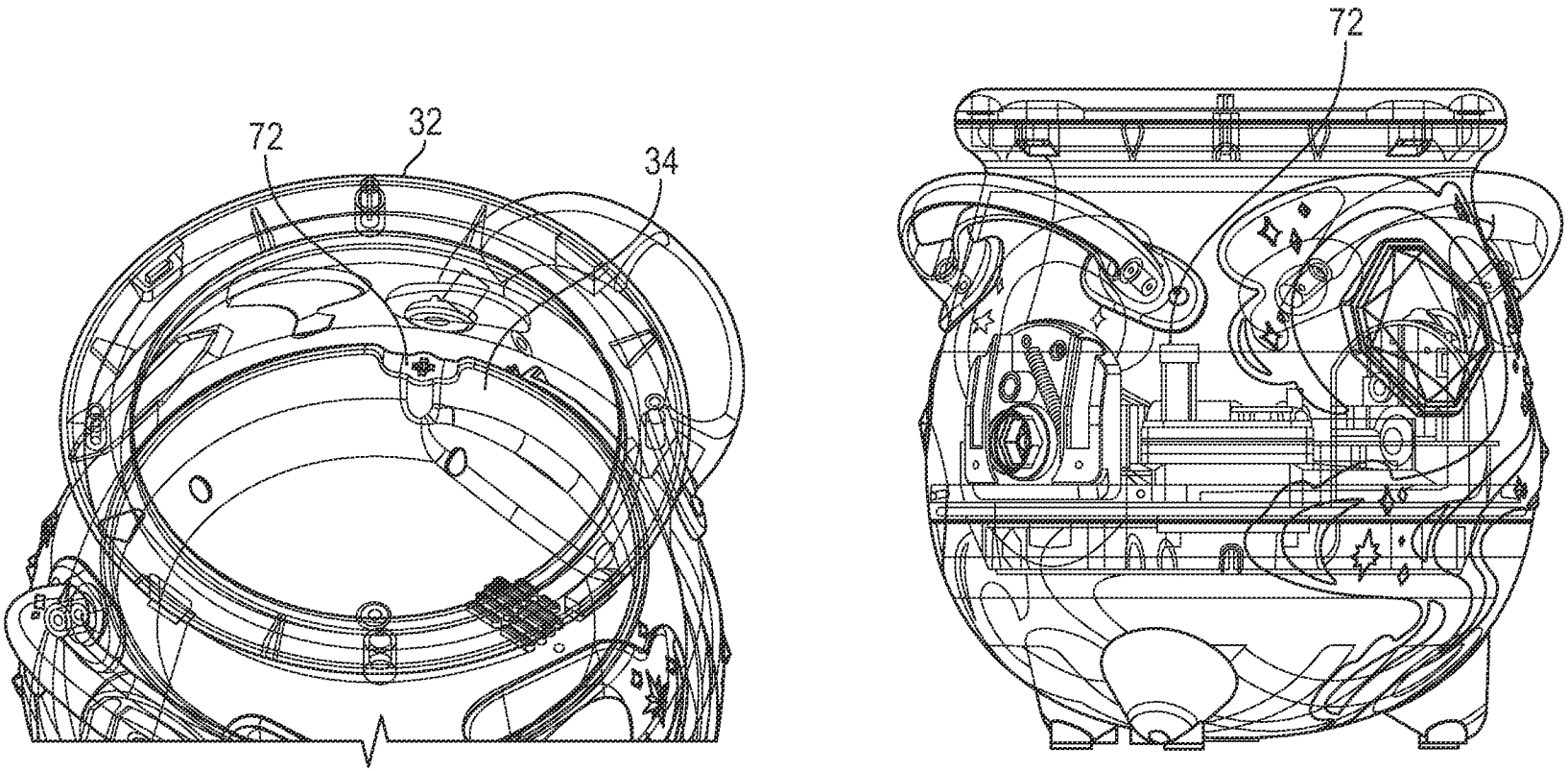
FIG. 8 is a front perspective view showing a passage through the carriage for refilling the fog system.
Figure 21:
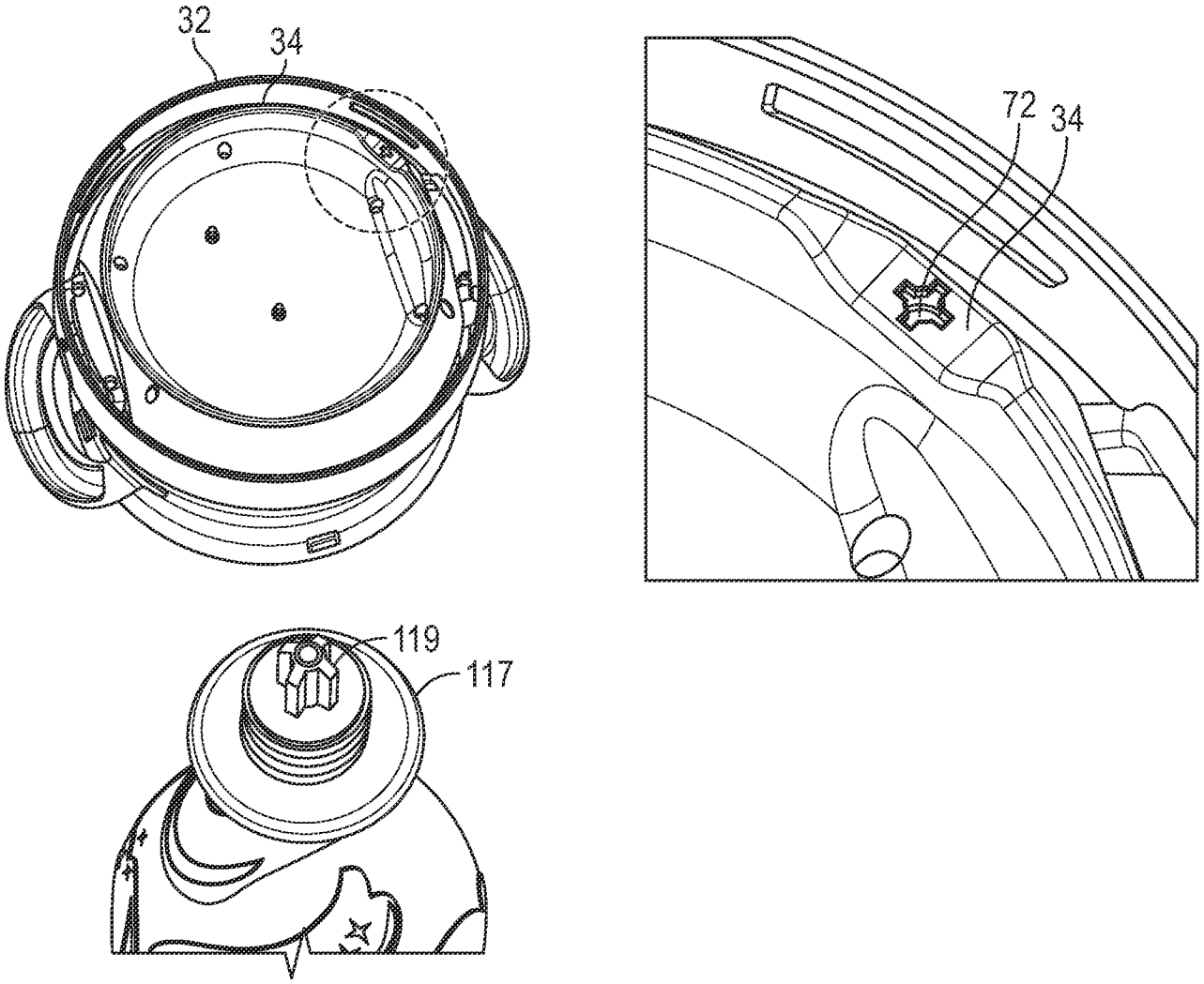
FIG. 21 illustrates views of an embodiment of a refill aperture into the opening.

FIG. 8 is a front perspective view showing a passage 72 through the carriage 34 for refilling the fog system 62. An exemplary shape of an aperture into the passage 72 is shown in FIG. 21. In certain embodiments, a user can refill the fog system 62 by squirting fog liquid into the aperture of the passage 72 in the carriage 34. A pipette and/or bottle can be used to add the fluid. In certain embodiments, the-pipette and/or bottle is provided in a refill pack.

Figure 9:
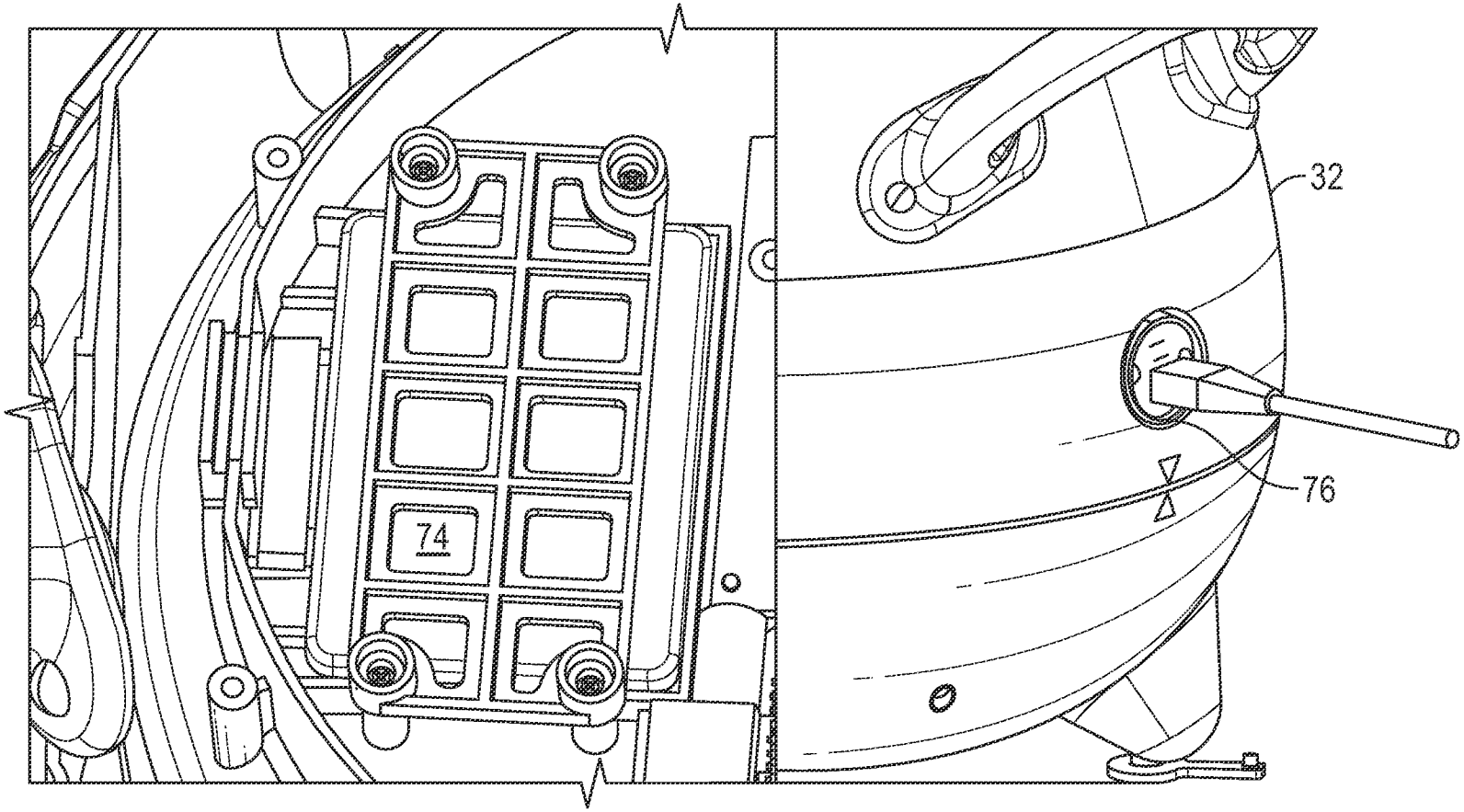
FIG. 9 are views of a battery disposed within the carriage and a charging port configured to receive electricity to charge the battery.

FIG. 9 are views of a battery 74 disposed within the carriage 34 and of a charging port 76 disposed in the container 32 and configured to receive electricity to charge the battery 74. In certain embodiments, the battery 74 is a lithium battery. A power cord can connect to the charging port 76 and provide electricity to the electronic components of the toy system 30.

Figure 10:
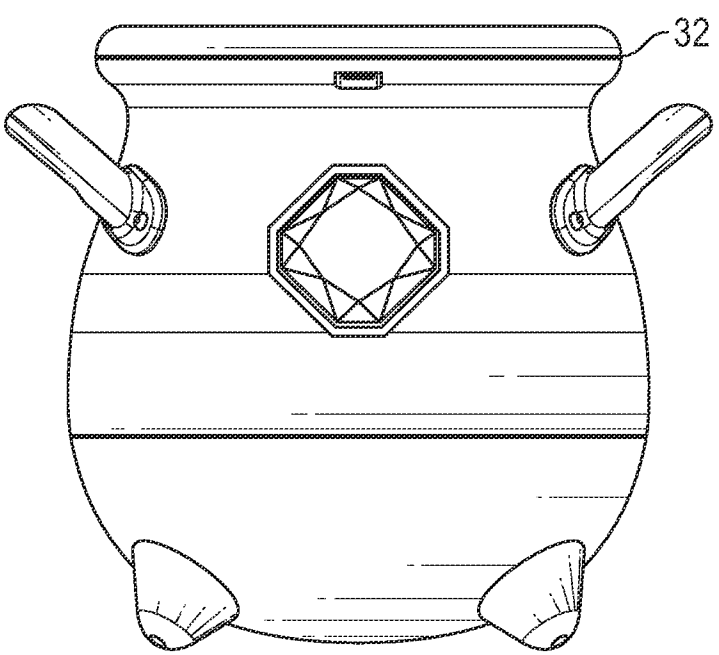
FIG. 10 includes an exploded view of an embodiment of the cauldron from FIG. 2 that includes a carriage subassembly and a front view of the cauldron.
Figure 10:
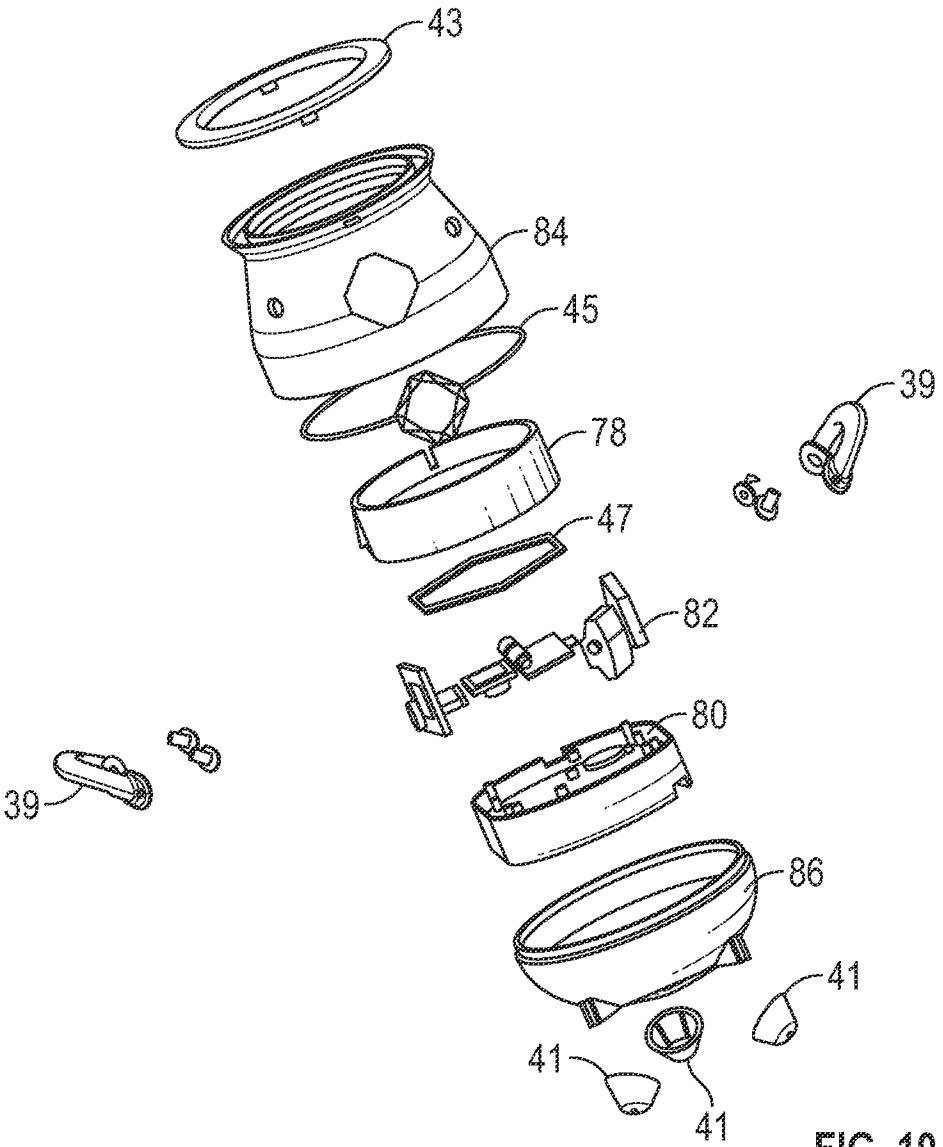

FIG. 10 includes an exploded view of an embodiment of the container or cauldron 32 from FIG. 2 that includes a carriage subassembly 82 and a front view of the cauldron 32. In certain embodiments, the container or cauldron 32 includes, for example, a carriage upper portion 78, a carriage lower portion 80, the carriage subassembly 82, the upper portion 84, and the lower portion 86. In certain embodiments, the container 32 includes one or more seals. In certain embodiments, the user can unscrew the lower portion 86 from the upper portion 84.

In certain embodiments, the toy system 30 comprises one or more handles 39. The one or more handles 39 can be configured to allow the user to move the toy system 30. In certain embodiments, the toy system 30 comprises one or more legs 41 configured to support the container 32 on a surface. In certain embodiments, the toy system 30 comprises a cover 43 configured to close out a top rim of the container 32. In certain embodiments, the toy system 30 comprises an outer bowl seal 45 and an inner bowl seal 47.

Figure 11:
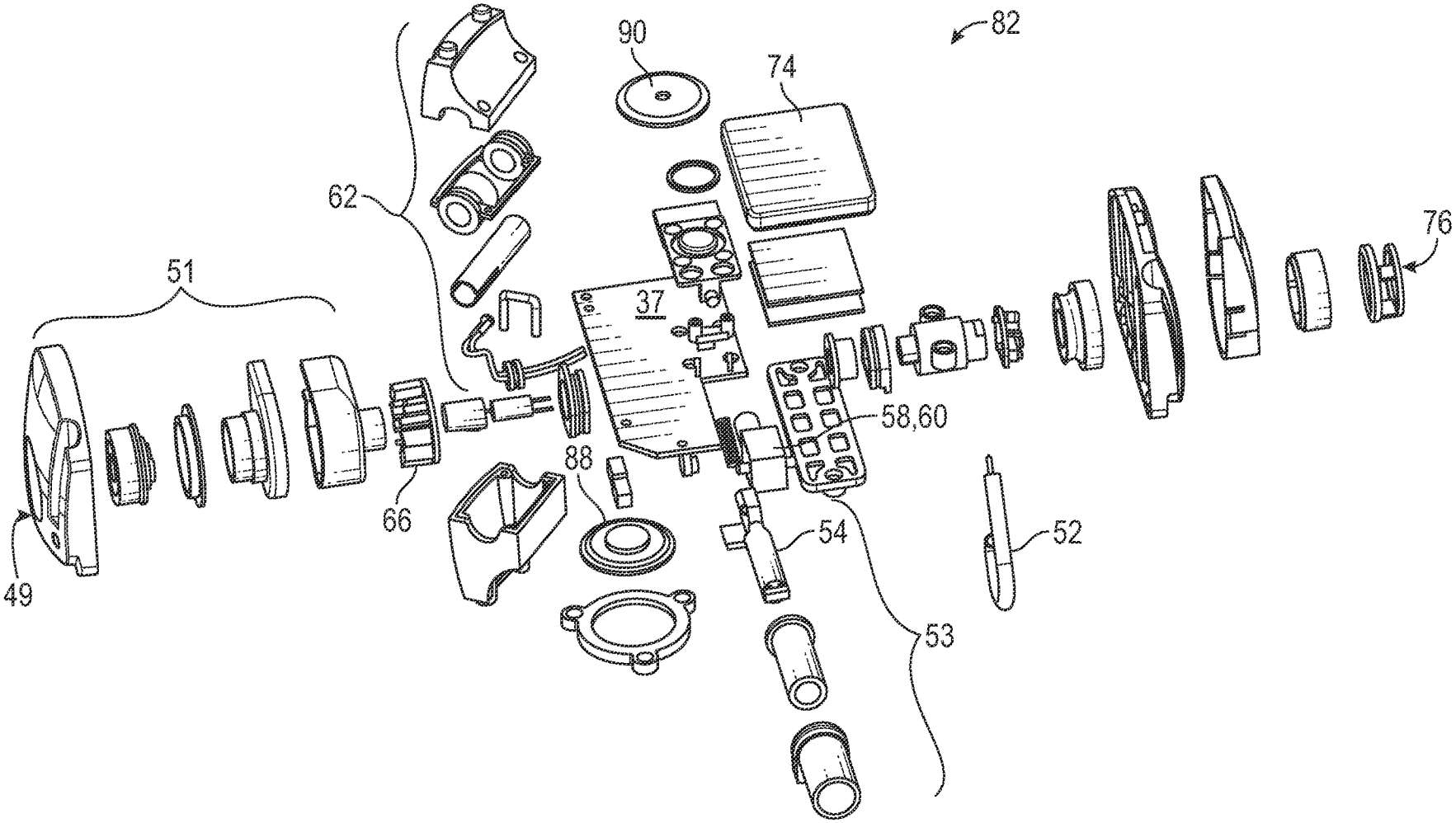
FIG. 11 is an exploded view of the carriage subassembly.

FIG. 11 is an exploded view of the carriage subassembly 82. In certain embodiments, the carriage subassembly 82 includes one or more of the fog system 62, a speaker 88, the motor 58, the gearbox 60, the battery 74, a knock sensor 90, and the charging port 76. In certain embodiments, the knock sensor 90 is configured to sense contact of the wand 100 with the edge of the container 32.

In certain embodiments, the carriage subassembly 82 comprises reset components 51. In certain embodiments, the reset components 51 comprises, for example, the keyhole 49. In certain embodiments, the carriage assembly 82 comprises a release mechanism 53. In certain embodiments, the release mechanism 53 comprises, for example, the pin 54.

FIG. 12 includes a series of views of the carriage 34 as the carriage 34 is rotated within the cauldron 32 from the first position 38 to the second position 40. In certain embodiments, the carriage 34 rotates 180 degrees. In certain embodiments, the water moves from the carriage 34 to the reservoir 50 when the carriage 34 is flipped or rotated. In certain embodiments, the toy 48 is held in place in the second receiving space 44 before the carriage 34 is rotated. For example, in certain embodiments, the toy 48 is suspended upside down within the second receiving space 44 when the carriage 34 is in the first position 38. In certain embodiments, once rotated to the second position 40, the second receiving space 44 is facing towards the top opening 46. In certain embodiments, the toy 48 is face-up within the second receiving space 44 when the carriage 34 is in the second position 40.

Figure 13:
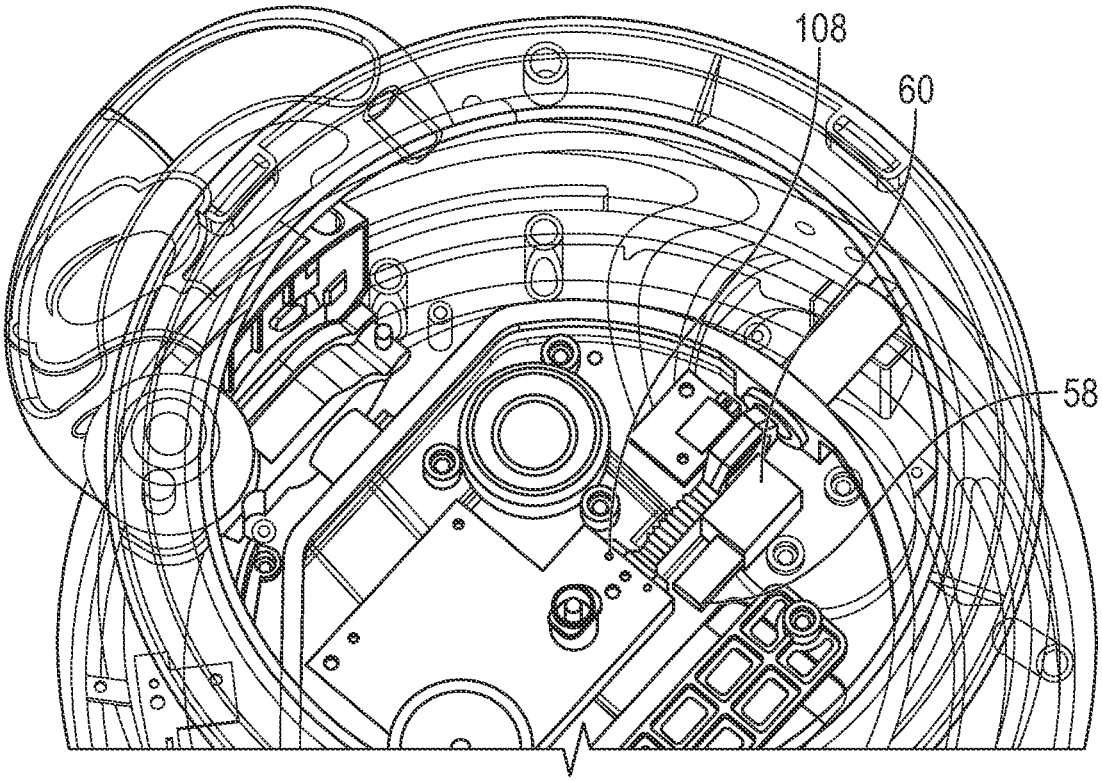
FIG. 13 illustrates the motor and gearbox which are configured to unlock the pin to allow the carriage to rotate.

FIG. 13 illustrates the motor 58 and the gearbox 60. In certain embodiments, the motor 58 and the gearbox 60 are configured to unlock the pin 54 to allow the carriage 34 to rotate between the first position 38 and the second position 40. In certain embodiments, the first receiving space 42 includes one or more water sensors 108. In certain embodiments, the one or more water sensors 108 sense when water is placed within the first receiving space 42. In certain embodiments, the one more sensors 108 activate the container 32.

Figure 14:
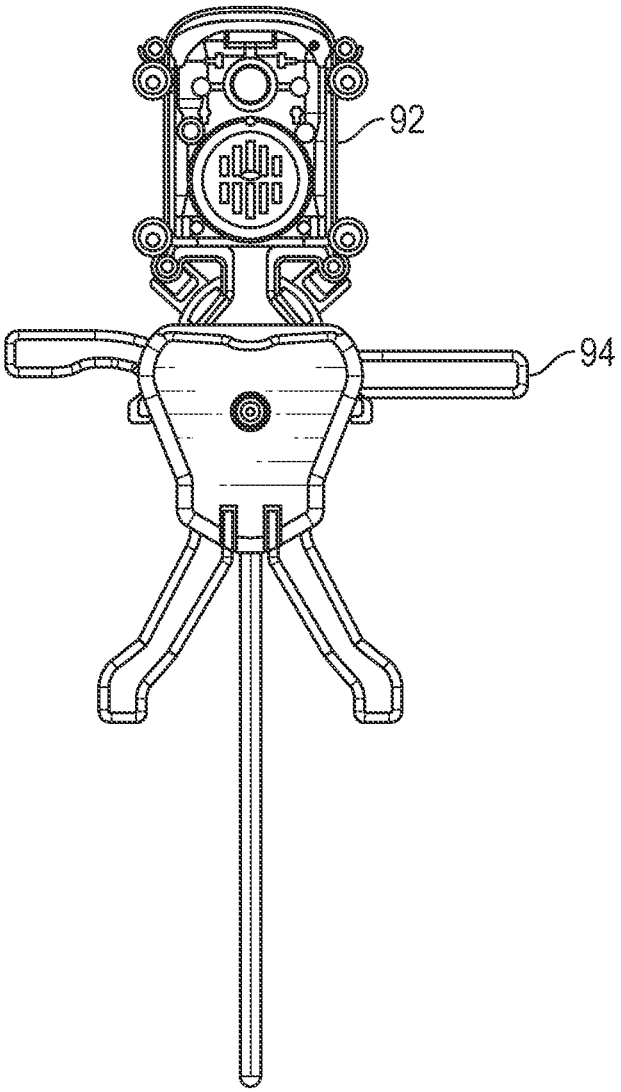
FIG. 14 is a plan view of a skeleton of the toy or doll from FIG. 1.

FIG. 14 is a plan view of a skeleton 94 of the toy/doll 48 from FIG. 1. The toy/doll 48 can further include a module 92. In the illustrated embodiment, each limb of the skeleton 94 is formed from a bendable wire. In certain embodiments, each limb of the skeleton 94 includes one or more interconnected links. In certain embodiments, each limb of the skeleton 94 is poseable.

Figure 15:
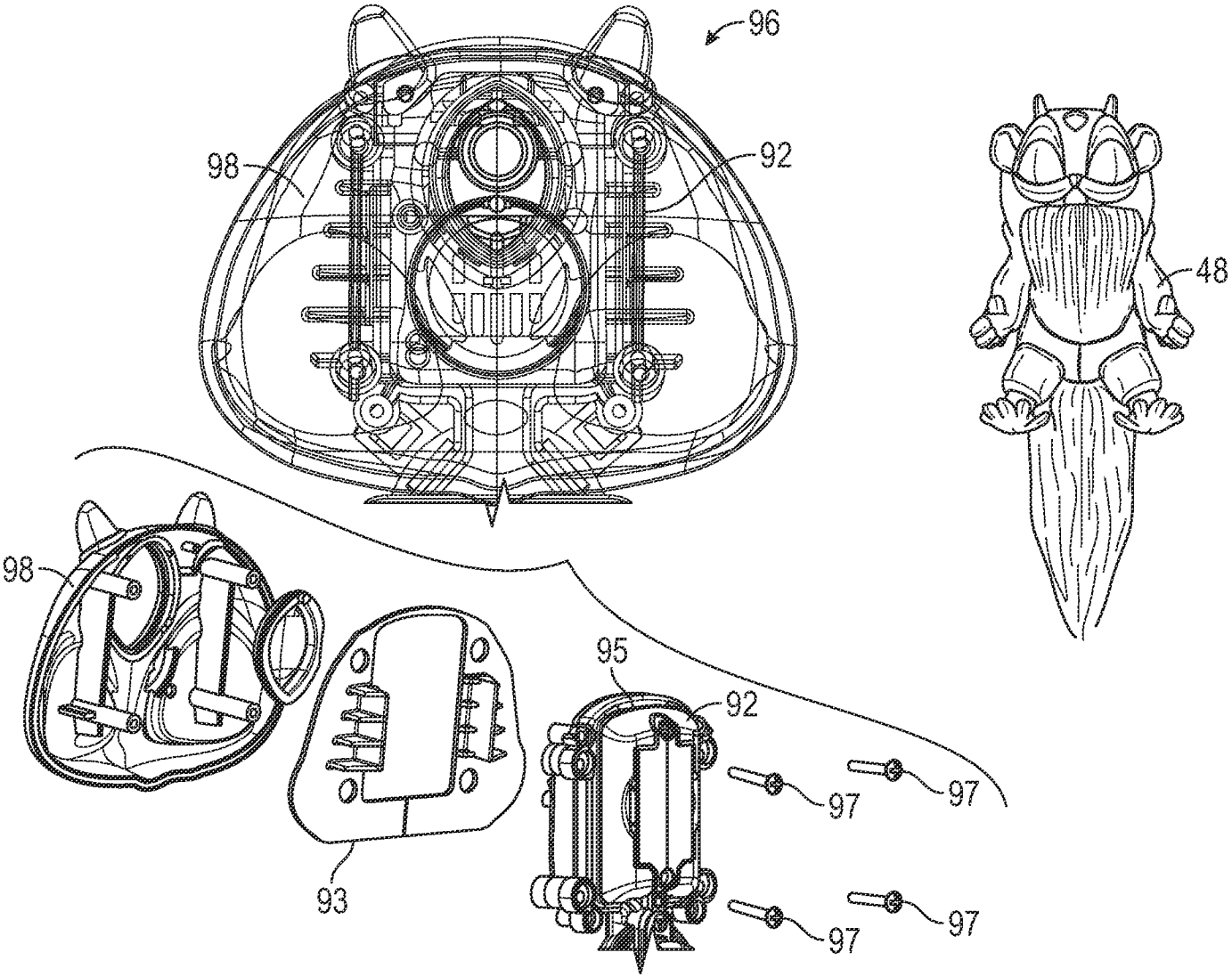
FIG. 15 includes views of a head of the toy or doll from FIG. 14.

FIG. 15 includes views of a head 96 of the toy/doll 48 from FIG. 14. The head 96 can enclose the module 92. In certain embodiments, the head 96 comprises a face plate 98 and a frame 93. In certain embodiments, the frame 93 supports the module 92 within the head 96. The module 92 can be configured to house one or more electronic components. In certain embodiments, the module 92 is secured by one or more screws 97 to the face plate 98 of the head 96.

In certain embodiments, the doll 48 includes one or more capacitive sensors 95. For example, in certain embodiments, an upper surface of the head 96 comprises the capacitive sensor 95. In certain embodiments, activation of the capacitive sensor 95 causes the toy/doll 48 to broadcast sound and/or emit light. In certain embodiments, the capacitive sensor 95 is activated by touch of the user.

Figure 16:
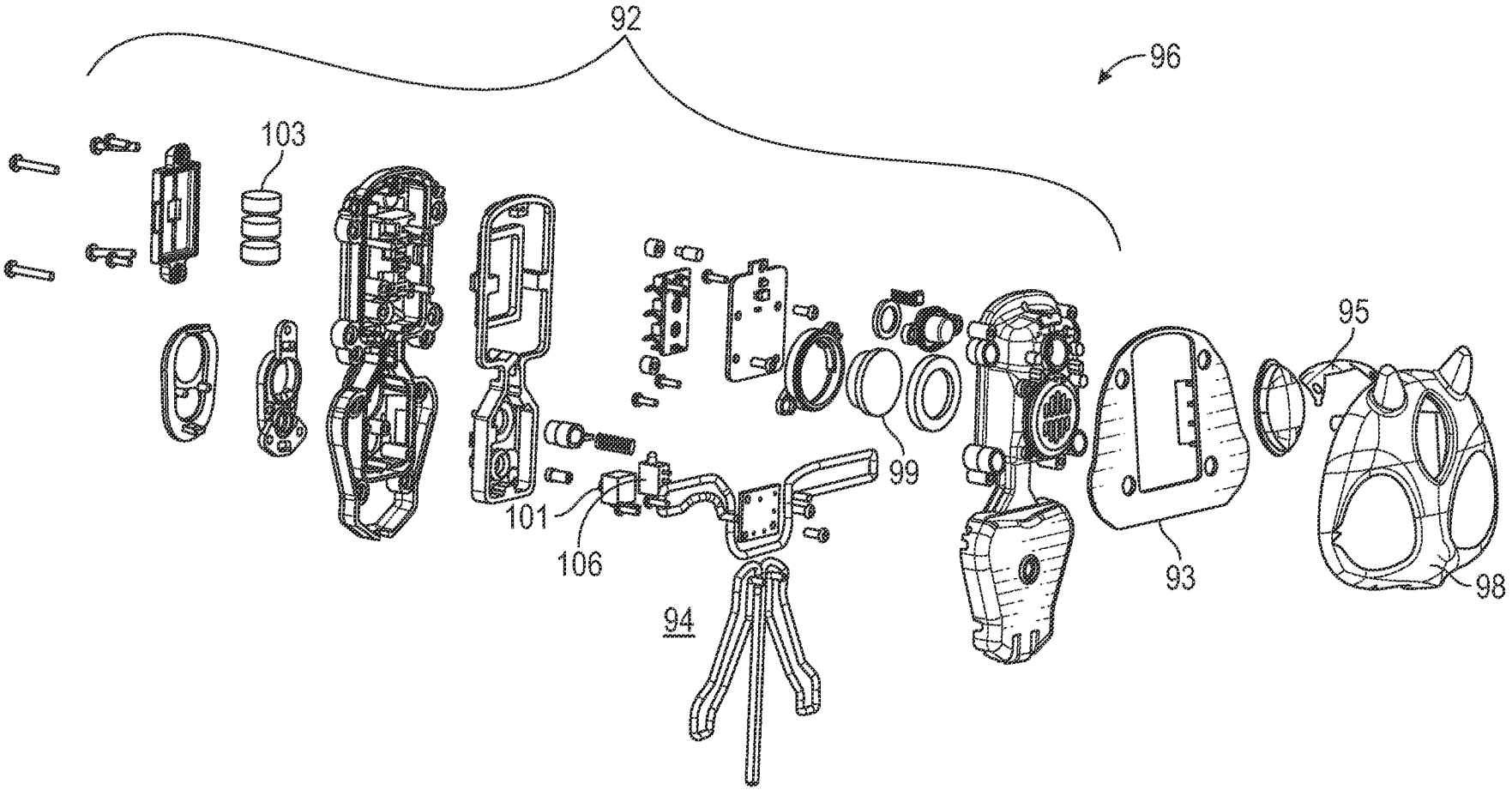
FIG. 16 is an exploded view of the toy or doll from FIG. 15.

FIG. 16 is an exploded view of the toy/doll 48 from FIG. 15. In certain embodiments, the head 96 comprises a speaker 99. In certain embodiments, the speaker 99 is configured to broadcast sound. In certain embodiments, the head 96 comprises the capacitive sensor 95. In certain embodiments, the head 96 comprises an on/off switch 101. In certain embodiments, the on/off switch 101 is configured to turn the toy/doll 48 off or on. In certain embodiments, the head 96 comprises one or more batteries 103. In certain embodiments, the one or more batteries 103 are three batteries. In certain embodiments, the one or more batteries 103 are 1.5 volt button cell type batteries. In certain embodiments, the batteries are 3 LR44 batteries. Of course, other numbers of batteries as well as types of batteries can be employed with the toy system 30 while staying within the scope of this disclosure. In certain embodiments, the head 92 includes a recessed switch 106.

Figure 17:
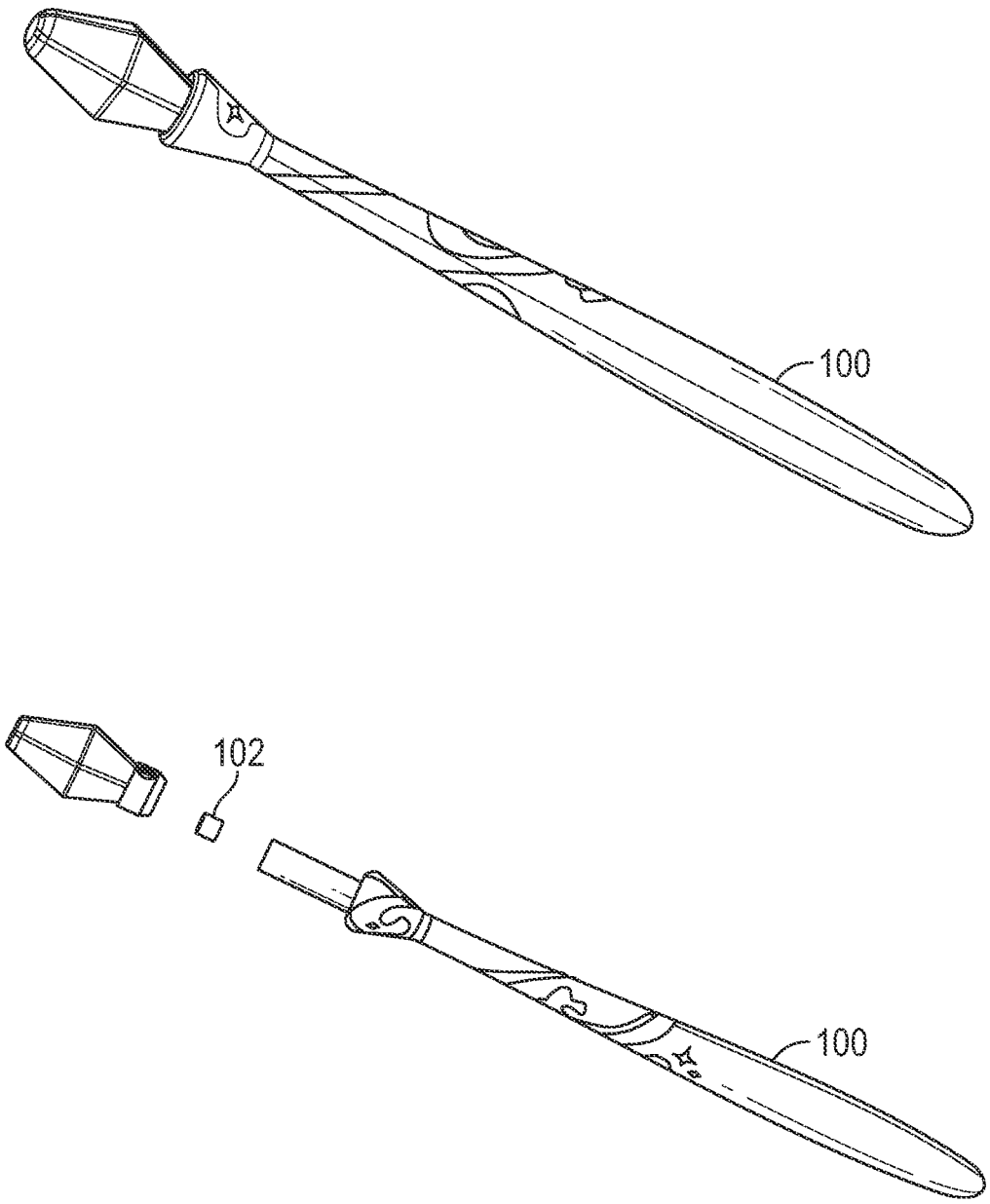
FIG. 17 includes perspective and exploded views of a wand for use with the cauldron and toy of FIG. 1.

FIG. 17 includes perspective and exploded views of a wand 100 for use with the container 32 and toy/doll 48 of FIG. 1. In certain embodiments, the wand 100 includes a magnet 102. In certain embodiments, the magnet 102 triggers a hall sensor in the toy 48 to cause the toy 48 to perform a predetermined action. In certain embodiments, the predetermined action is to make sounds and cause the gem on the head 92 to light up. In certain embodiments, the wand 100 includes an inductor.

Figure 18:
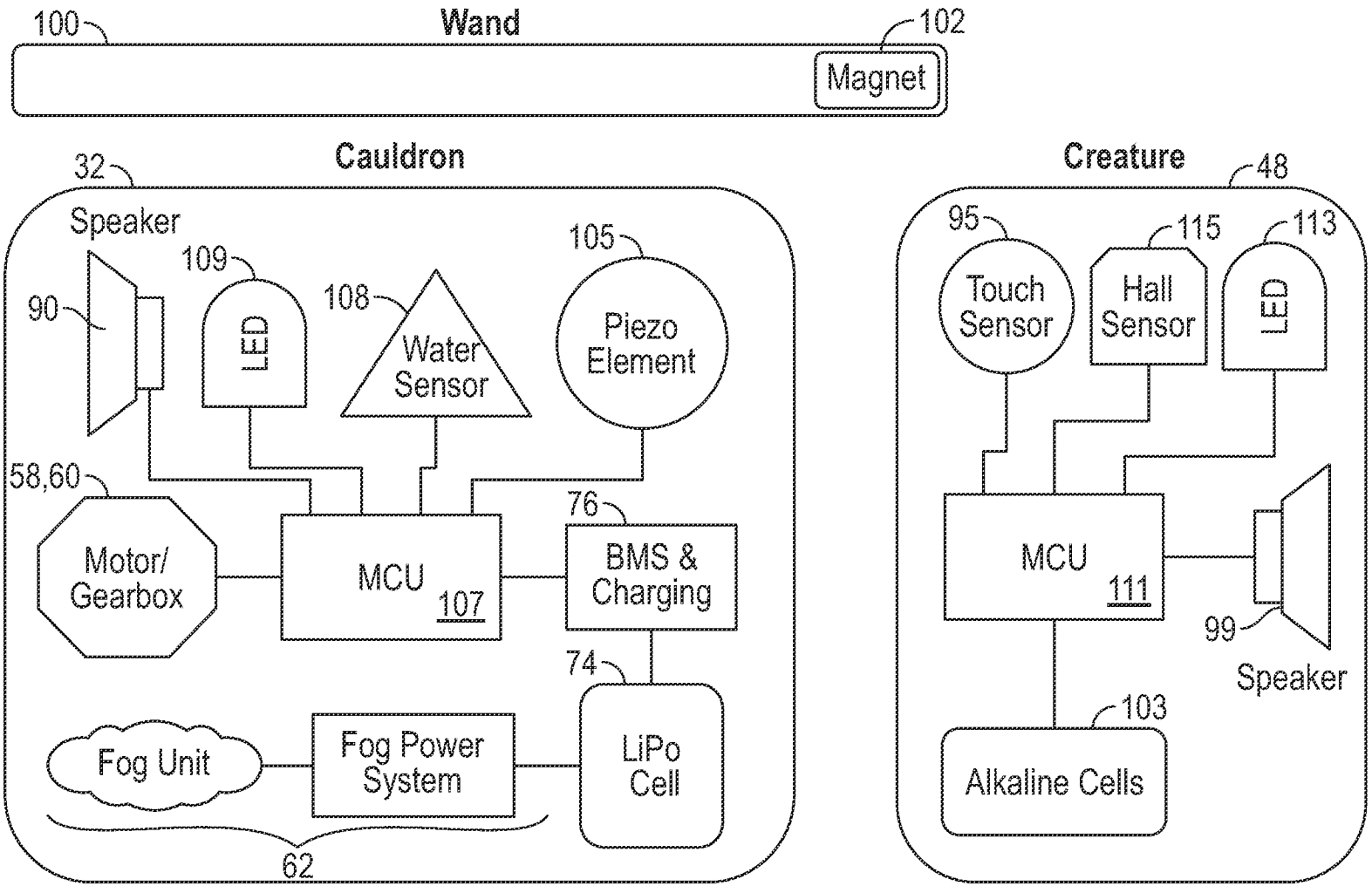
FIG. 18 are schematic views of the cauldron and toy/doll from FIG. 1.

FIG. 18 are schematic views of the container or cauldron 32 and the toy/doll 48 from FIG. 1. A schematic of an embodiment of the wand 100 is also provided. In certain embodiments, the doll 48 can be wirelessly charged by the container 32. In certain embodiments, the container or cauldron 32 can include one or more of the motor 58, one or more LEDs 109, a water sensor 108, a piezo element 105, the fog system and power circuit 62, a microcontroller (MCU) 107, and a battery 74. In embodiments that include a wireless charging feature, the container 32 can further include a wireless power coil and driver circuit for the power coil.

In certain embodiments, the toy 48 can include the capacitive sensor 95, a speaker 99, a microcontroller (MCU) 111, and one or more LEDs 113. In certain embodiments, the toy 48 can include a hall sensor 115. In embodiments that include a wireless charging feature, the toy 48 can further include a capacitor and a wireless power receiver.

Figure 19:
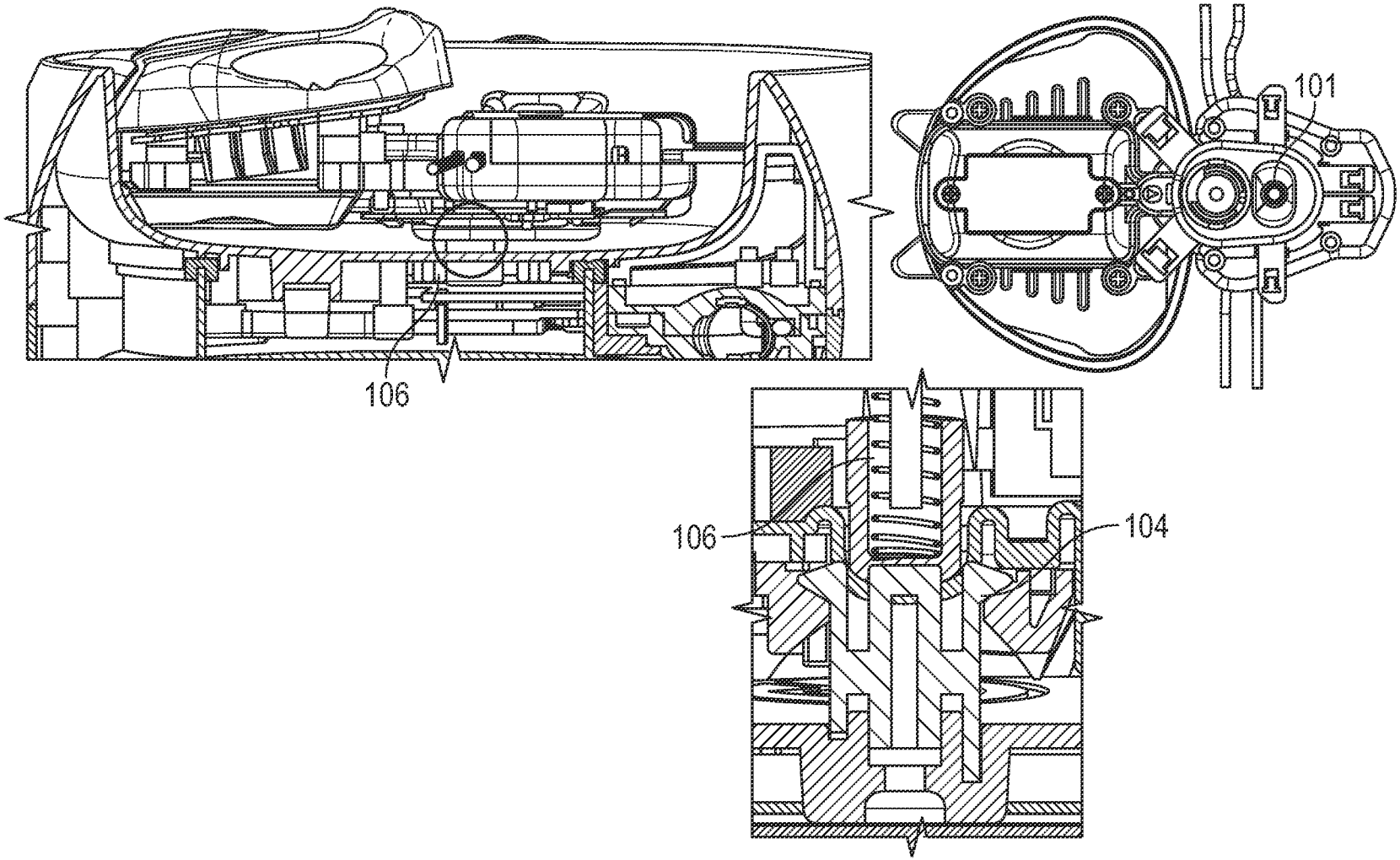
FIG. 19 shows releasable connections for attaching the toy/doll to the carriage.

FIG. 19 shows releasable connections for attaching the doll 48 to the carriage 34. In certain embodiments, the container 32 includes a switch for a user to select a mode of operation. In certain embodiments, the modes of operation include a birth mode, a spell mode, and an off mode. In certain embodiments, the user can select the birth mode when they first use the product. In certain embodiments, the birth mode can be repeatably used if the user wants to re-birth the toy 48. In certain embodiments, the toy system 30 is provided to the user initially in birth mode. In certain embodiments, the spell mode is selected after the user has already birthed the toy 48 but wants to make additional spells.

In certain embodiments, the releasable connections are one or more plugs or retention clips 104. In certain embodiments, the toy 48 can be held in the container 32 using the one or more plugs or retention clips 104. In certain embodiments, the one or more plugs or retention clips 104 can project from the second receiving space 44 and fit into one or more holes in a body and/or head 96 of the toy 48. In certain embodiments, the one or more plugs or retention clips 104 can grip or hold the toy 48. For example, the one or more plugs or retention clips 104 can grip or pinch a portion (e.g., limb) of the toy 48.

In certain embodiments, the head 96 can include a recessed switch 106 and cover. For example, when the one or more plugs or retention clips 104 are inserted into the hole, the recessed switch 106 will be pressed deactivating the toy 48. In certain embodiments, when the one or more plugs or retention clips 104 are removed from the hole, the recessed switch 106 will disengage from the one or more plugs or retention clips 104 and activate or turn on the toy 48. In certain embodiments, the one or more plugs or retention clips 104 can engage with the hole in a press fit manner and/or include a locking feature which inhibits the one or more plugs or retention clips 104 from falling out of the hole when the toy 48 is upside down and attached to the second receiving space 44 when the carriage 34 is in the second position 40.

Figure 20:
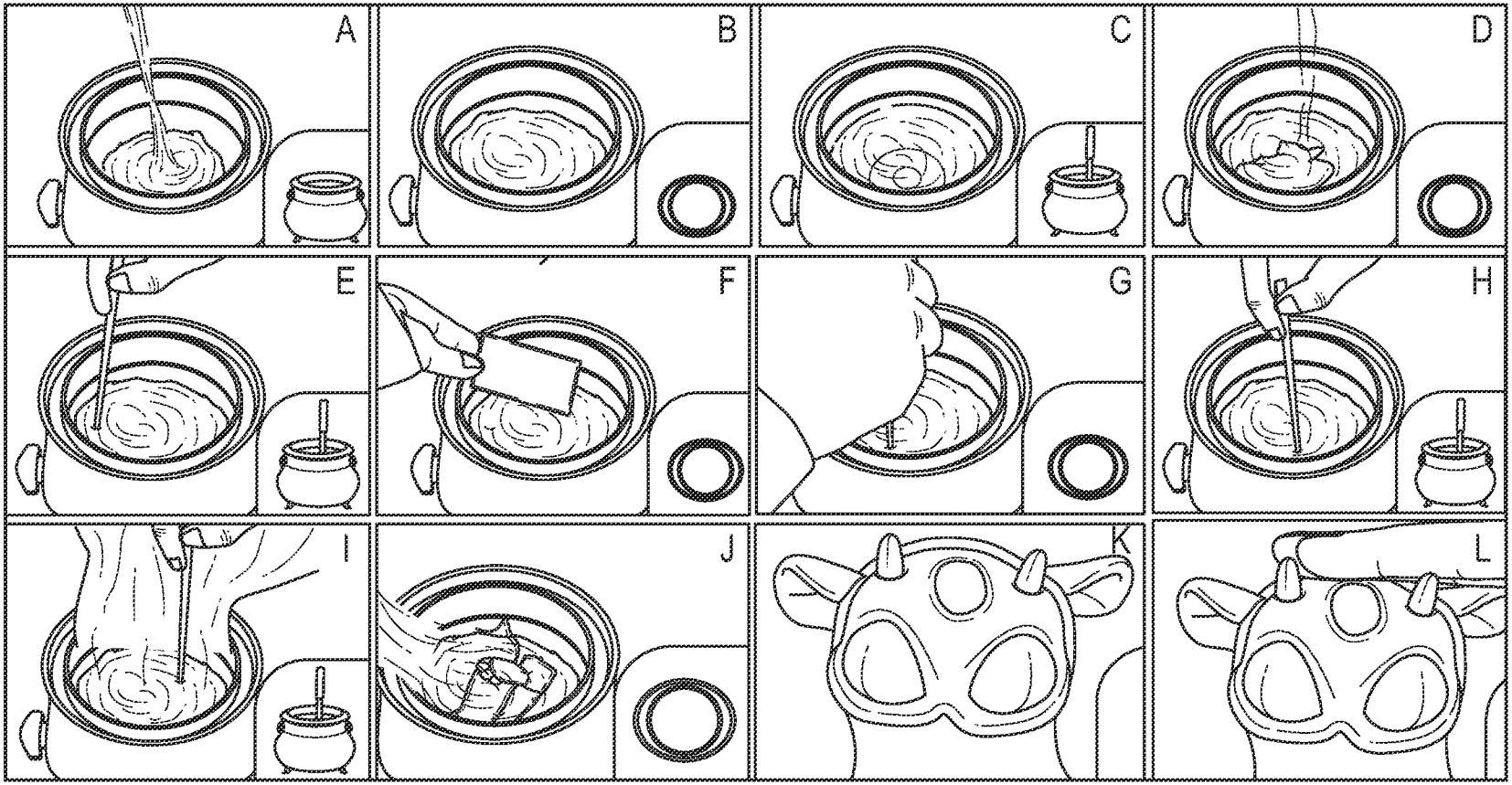
FIG. 20 illustrates an exemplary method for playing with the toy system.

FIG. 20 illustrates an exemplary method for playing with the toy system 30. The described methods are only exemplary. Any of the steps can be rearranged in order or omitted while staying within the scope of this disclosure.

In certain embodiments, at Step A, water is added to the cauldron 32 to trigger the water sensor 108. Next, at step B, a water-soluble material is added to the water. In certain embodiments, the user can stir the potion and tap the side of the cauldron 32 with the wand 100 at step C. In certain embodiments, a user can add a fizz to the potion at step D. At step E, in certain embodiments, the user can stir the potion and tap the side of the cauldron 32 with the wand 100 to proceed. In certain embodiments, the user can write the name of their toy/doll 48 on the water-soluble paper at step F. In certain embodiments, the paper can be added to the potion at step G. In certain embodiments, at step H, the user can stir the potion and tap the side of the cauldron 32 with the wand 100 to proceed. In certain embodiments, the fog appears and then the toy/doll 48 is revealed at step I. In certain embodiments, the user can remove the toy/doll 48 from the cauldron 32 at step J. Once removed the gem in the head of the toy/doll 48 lights up at step K, in certain embodiments. In certain embodiments, petting the head 96 can trigger the capacitive sensor 95 at step L. In certain embodiments, the magnet in the wand 100 can trigger a hall sensor 115. In certain embodiments, the toy/doll 48 can be clipped to the cauldron 32 to receive wireless power.

Another exemplary method of play includes the toy system 30 first being activating by water contacting the first receiving space 42. Next, the user adds one or more fizzes and water-soluble items to make a potion in the first receiving space 42. The user taps the container 32 with the wand 100 to progress through the potion process. The container 32 lights up and makes sounds. The container 32 releases fog and the carriage 34 turns to the second position 40 revealing the toy 48. An end of the wand 100 can light up when placed near the container 32. In certain embodiments that include wireless charging, the container 32 comprises an induction coil. The induction coil can activate the wand 100. The wand 100 can trigger the hall sensor in the toy 48 to cause the toy 48 to make sounds and the gem on its head to light up. When the cap sensor 95 in the toy 48 is activated, the toy 48 can also broadcast sound and emit light. In certain embodiments, the toy 48 is charged using wireless power transfer from the induction coil in the container 32.

FIG. 21 illustrates views of an embodiment of a fog fluid refill aperture 72. In certain embodiments, the opening 72 for refilling the fog system 62 with the fog liquid has a shape that matches a shape of the refill bottle 117. In this way, the refill bottle 117 has a corresponding shape nozzle 119 to the shape of the opening 72. In the illustrated embodiment, the opening 72 has a cross-shape 119 with a maximum diameter that prohibits filling the fog system 62 through the opening 72 with typical household bottles or syringes. Of course, the shape of the opening 72 and the nozzle 119 of the refill bottle 117 need not be cross-shaped. Other shapes fall within the scope of the disclosure.

Figure 22:
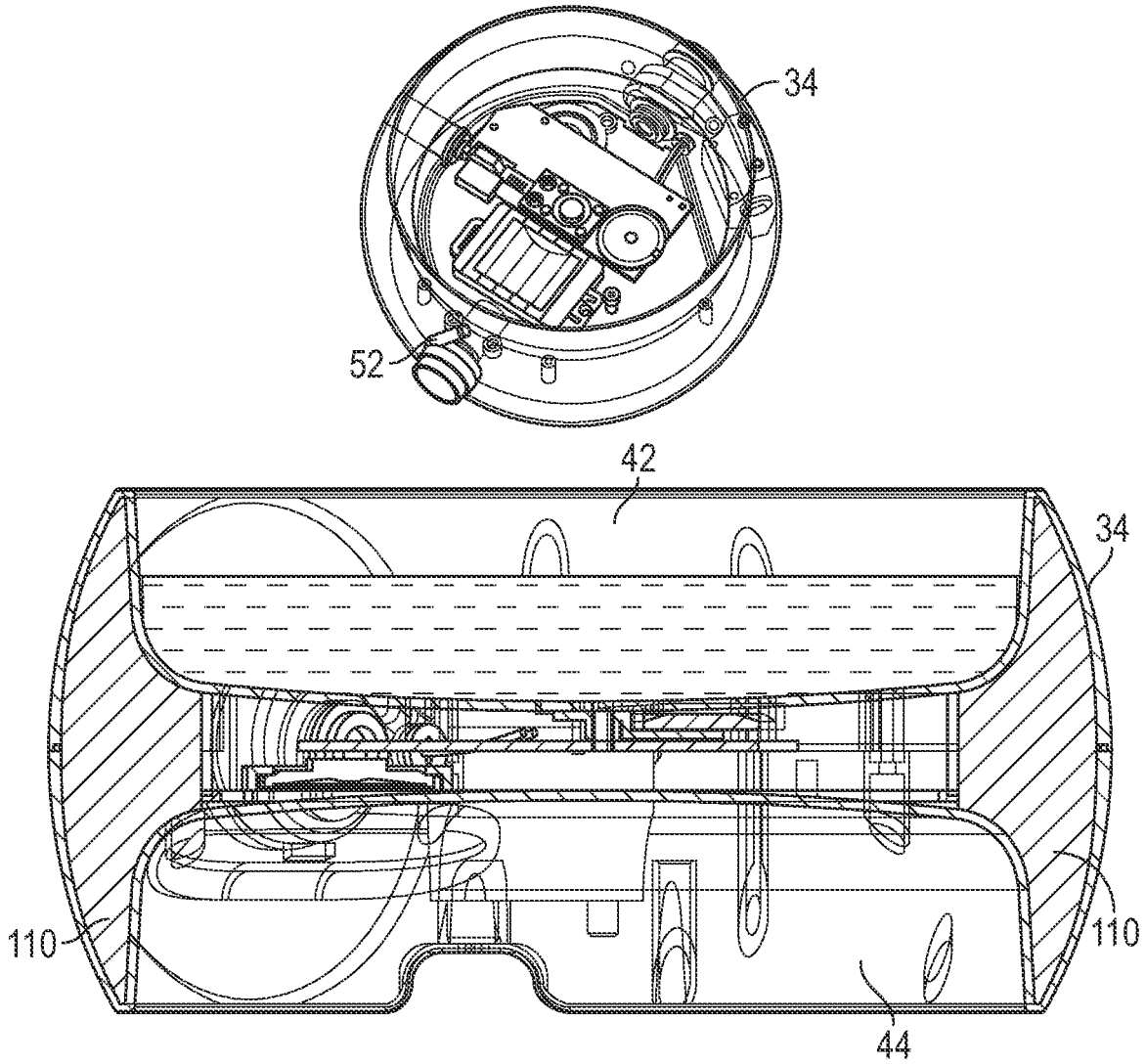
FIG. 22 illustrates views of an embodiment of a duct for the fog system within the carriage.

FIG. 22 illustrates views of an embodiment of the duct 110 for the fog system 62. In the illustrated embodiment, at least a portion of the duct 110 is disposed in the carriage 34. In certain embodiments, the volume of the duct 110 is large enough to allow time for the fog to cool before exiting the duct 110 and the carriage 34. An exemplary volume for the duct 110 is illustrated in FIG. 22.

In certain embodiments, the fog leaves the fog system 62 and then enters the duct 110 in the carriage 34. In certain embodiments, the volume of the duct 110 is selected to cause the fog leaving the heater coil 64 to cool before eventually exiting the carriage 34 and entering the first receiving space 42. In certain embodiments, the geometry (e.g., size, volume, length, width, height, area, etc.) of the one or more ducts 110 can vary. For example, in certain embodiments, the geometry of the one or more ducts 110 can be selected to achieve a desirable decrease in the temperature of the fog. In certain embodiments, cooling the fog within the one or more ducts 110 can increase the density of the fog causing the fog to stay closer to the surface of the first receiving space 42 rather than immediately rise and exit the top opening 46.

In the illustrated embodiment, the duct 110 is located adjacent to the first receiving space 42. For example, in the illustrated embodiment, the duct 110 is located adjacent to a surface or wall that forms the first receiving space 42. In certain embodiments, when the first receiving space 42 is filled with room temperature water, a temperature of the wall will be lower than the temperature of the heated fog when the fog leaves the heater coil 64. In certain embodiments, flowing the warmed fog through the duct 110 as well as adjacent to the filled first receiving space 42, further lowers the temperature of the fog. In this way, the density of the fog, which may have been less than the density of the surrounding air when exiting the heater coil 64, is increased to a value that is greater that the density of the surrounding air. In certain embodiments, the fog system 62 includes one or more exit holes 33. In certain embodiments, the one or more exit holes 33 can be distributed around a periphery of the carriage 34 to evenly distribute the fog within the container 32.

Figure 23:
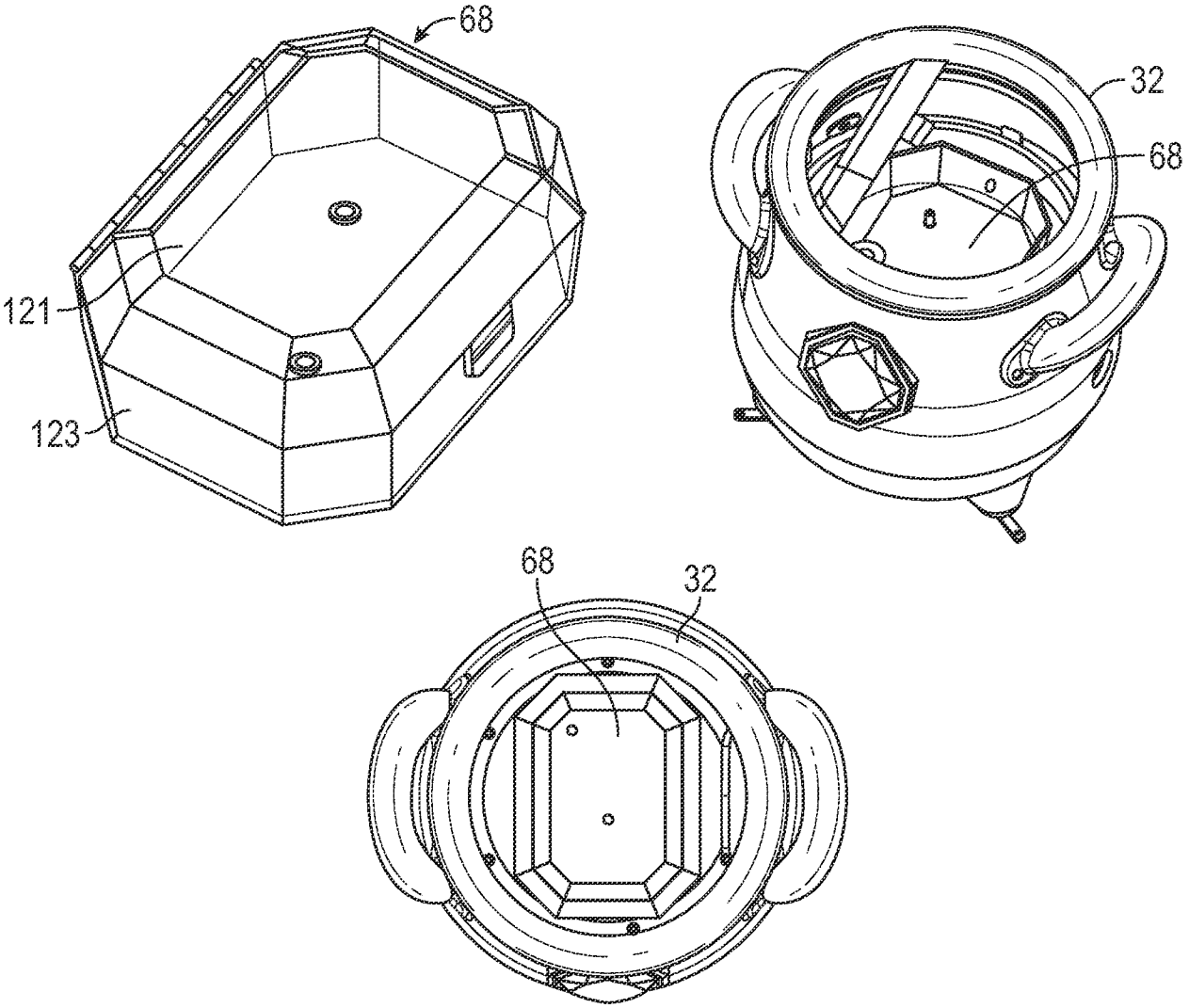
FIG. 23 illustrates views of an embodiment of an enclosure for allowing items other than the doll or toy to be revealed.

FIG. 23 illustrates views of an embodiment of an enclosure 68 for allowing items other than the doll or toy 48 to be revealed. In certain embodiments, the enclosure 68 includes a base 123 and a cover 121. In the illustrated embodiment, the cover 121 is hinged to the base 123 and can be opened and closed relative to the base 123 to allow the user to access an interior of the enclosure 68.

In certain embodiments, the enclosure 68 is configured to be secured in the second receiving space 44. For example, the enclosure 68 can include one or more receptacles configured to receive the one or more posts or retention clips 104 that extend from the second receiving space 44. In this way, the enclosure 68 stays connected to the second receiving space 44 when the carriage 34 is upside down in the first position 38. The disclosure is not limited to the illustrated embodiment and can instead include any other fastener known to a person having ordinary skill in the art.

Terminology

Although certain embodiments and examples are disclosed herein, inventive subject matter extends beyond the examples in the specifically disclosed embodiments to other alternative embodiments and/or uses, and to modifications and equivalents thereof. Thus, the scope of the claims appended hereto is not limited by any of the particular embodiments described above. For example, in any method or process disclosed herein, the acts or operations of the method or process may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent. Additionally, the structures, systems, and/or devices described herein may be embodied as integrated components or as separate components. For purposes of comparing various embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

For expository purposes, the term "horizontal" as used herein is defined as a plane parallel to the plane or surface of the floor or ground of the area in which the device being described is used or the method being described is performed, regardless of its orientation. The term "floor" floor can be interchanged with the term "ground." The term "vertical" refers to a direction perpendicular to the horizontal as just defined. Terms such as "above," "below," "bottom," "top," "side," "higher," "lower," "upper," "over," and "under," are defined with respect to the horizontal plane.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without other input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, 0.1 degree, or otherwise.

What is claimed is:

1. A toy system comprising:

a container forming a receptacle and having a top opening, the container being configured to sit on a surface with the top opening facing in an upward direction;

a carriage disposed in the receptacle and rotatable about an axis between a first position and a second position, the carriage having a first receiving space and a second receiving space, the first receiving space being configured to hold a liquid when the carriage is in the first position, the first receiving space being accessible through the top opening when the carriage is in the first position and inaccessible when the carriage is in the second position, the second receiving space being accessible through the top opening when the carriage is in the second position and inaccessible when the carriage is in the first position, and a fog system configured to generate fog within the container, the fog obfuscating the first receiving space, wherein a portion of the receptacle below the carriage comprises a reservoir, the reservoir being configured to hold the liquid when the carriage is moved to the second position.

2. The toy system of claim 1, further comprising a toy or doll disposed in the second receiving space, the toy being accessible through the top opening when the carriage is in the second position.

3. The toy system of claim 2, further comprising a wand having a magnet, and wherein the toy further comprises a hall sensor, the hall sensor being triggered when in the presence of the magnet to cause the toy to broadcast sound and emit light.

4. The toy system of claim 2, wherein the toy comprises a capacitive sensor, the capacitive sensor being configured to cause the toy to broadcast sound and emit light when activated.

5. The toy system of claim 1, wherein the container is sized and shaped as a cauldron, and wherein the cauldron comprises an upper portion and a lower portion, the lower portion being removable from the upper portion.

6. The toy system of claim 1, wherein rotation of the carriage about the axis transfers the liquid from the first receiving space to the receptacle.

7. The toy system of claim 6, wherein transfer of the liquid from the first receiving space to the receptacle is due to gravity.

8. The toy system of claim 1, further comprising one or more springs and a lock, the one or more springs being configured to bias rotation of the carriage to the second position, the lock having a lock position and an unlock position, the lock preventing the one or more springs from rotating the carriage to the second position when the lock is in the lock position.

9. The toy system of claim 8, further comprising a motor and gearbox configured to move the lock to the unlock position allowing the one or more springs to rotate the carriage to the second position.

10. The toy system of claim 1, wherein the fog system comprises a heater coil and a fan, the heater coil being configured to cause a phase change of a liquid into the fog, the fan being configured to blow the fog into at least the first receiving space.

11. The toy system of claim 10, wherein the liquid is vegetable glycerin, propylene glycol, and water or mix thereof.

12. The toy system of claim 10, further comprising one or more lights, the one or more lights being disposed in the receptacle and configured to illuminate the fog and other liquid in the first receiving space.

13. The toy system of claim 1, wherein the fog system comprises a heater coil and a fan, the heater coil being configured to cause a phase change of a liquid into the fog, the fan being configured to blow the fog into the second receiving space first, then rising into the first receiving space.

14. The toy system of claim 1, wherein the container further comprises a knock sensor configured to detect a vibration or a knock against the container.

15. The toy system of claim 1, wherein the second position is 180 degrees about the axis from the first position.

16. The toy system of claim 1, wherein the carriage is rotatable about the axis when a user moves the carriage from the second position to the first position.

17. The toy system of claim 1, wherein the top opening is in register with the first receiving space when the carriage is in the first position and in register with the second receiving space when in the second position.

18. The toy system of claim 1, further comprising an enclosure, the enclosure being configured to releasably secure to the second receiving space, the enclosure being sized and shaped to receive another toy.

19. A toy system comprising:

a container forming a receptacle and having a top opening, the container being configured to sit on a surface with the top opening facing in an upward direction;

a carriage disposed in the receptacle and configured to rotate 180 degrees about an axis between a first position and a second position, the carriage having a first receiving space and a second receiving space, the first receiving space being configured to hold a liquid when the carriage is in the first position; and a fog system configured to generate fog within the container, the fog obfuscating the first receiving space, wherein a portion of the receptacle below the carriage comprises a reservoir configured to receive and hold the liquid when the carriage is moved to the second position.

20. The toy system of claim 19, wherein the first receiving space is accessible through the top opening when the carriage is in the first position and inaccessible when the carriage is in the second position, the second receiving space being accessible through the top opening when the carriage is in the second position and inaccessible when the carriage is in the first position.

21. The toy system of claim 19, wherein rotation of the carriage about the axis transfers the liquid from the first receiving space to the reservoir.

22. A toy system comprising:

a container forming a receptacle and having a top opening, the container being configured to sit on a surface with the top opening facing in an upward direction; and a carriage disposed in the receptacle and rotatable about an axis between a first position and a second position, the carriage having a receiving space configured to hold a liquid when the carriage is in the first position, the receiving space being accessible through the top opening when the carriage is in the first position and inaccessible when the carriage is in the second position; and a fog system configured to generate fog within the container, the fog obfuscating the first receiving space, wherein a portion of the receptacle below the carriage comprises a reservoir configured to receive and hold the liquid from the receiving space when the carriage is moved to the second position.

* * * * *